US010807840B2

(12) United States Patent
Yamamoto

(10) Patent No.: US 10,807,840 B2
(45) Date of Patent: Oct. 20, 2020

(54) COUNTERWEIGHT DEVICE AND CONSTRUCTION MACHINE

(71) Applicant: SUMITOMO HEAVY INDUSTRIES CONSTRUCTION CRANES CO., LTD., Tokyo (JP)

(72) Inventor: Kazunori Yamamoto, Aichi (JP)

(73) Assignee: SUMITOMO HEAVY INDUSTRIES CONSTRUCTION CRANES CO., LTD., Tokyo (JP)

( * ) Notice: Subject to any disclaimer, the term of this patent is extended or adjusted under 35 U.S.C. 154(b) by 237 days.

(21) Appl. No.: 15/902,796

(22) Filed: Apr. 17, 2018

(65) Prior Publication Data

US 2018/0273354 A1 Sep. 27, 2018

(30) Foreign Application Priority Data

Feb. 28, 2017 (JP) ..... 2017-036813

(51) Int. Cl.
*B66C 23/74* (2006.01)
*B66C 23/68* (2006.01)

(52) U.S. Cl.
CPC ..... *B66C 23/74* (2013.01); *B66C 23/68* (2013.01)

(58) Field of Classification Search
CPC ..... B66C 23/72; B66C 23/74; B66C 23/76; B66C 23/68; E02F 9/18; B62D 49/085
See application file for complete search history.

(56) References Cited

U.S. PATENT DOCUMENTS 5,199,583 A * 4/1993 Weider ..... B66C 23/74 212/178
2006/0103125 A1* 5/2006 Yamamoto ..... B62D 49/085 280/760
2013/0001492 A1* 1/2013 Suzuki ..... E02F 9/2225 254/93 VA (Continued)

FOREIGN PATENT DOCUMENTS

JP 07268908 A * 10/1995 ..... E02F 9/18
JP 08302746 A * 11/1996 ..... E02F 9/18
JP 08319637 A * 12/1996 ..... E02F 9/18

(Continued)

*Primary Examiner* — Michael R Mansen
*Assistant Examiner* — Juan J Campos, Jr.
(74) *Attorney, Agent, or Firm* — Michael Best & Friedrich LLP

(57) ABSTRACT

A counterweight device installed in a rear end portion of a machine body frame includes amounting table having amounted counterweight, a hydraulic cylinder that raises/lowers the mounting table, a connection structure that connects the mounting table and a cylinder rod of the hydraulic cylinder, a support member that supports the hydraulic cylinder on the mounting table via an oscillating spindle, a first coupling mechanism that couples the connection structure and the rear end portion of the machine body frame to each other at a position where an upper end of the rear end portion is lower than an upper end of the connection structure, a second coupling mechanism that couples the support member and the rear end portion of the machine body frame to each other, a first operation unit that operates the first coupling mechanism, and a second operation unit that operates the second coupling mechanism.

10 Claims, 19 Drawing Sheets

(56) References Cited

U.S. PATENT DOCUMENTS

| | | | | |
|---|---|---|---|---|
| 2017/0210432 | A1* | 7/2017 | Cartechini | B66C 23/74 |
| 2018/0222729 | A1* | 8/2018 | Iguchi | B66C 23/74 |

FOREIGN PATENT DOCUMENTS

| | | | | | |
|---|---|---|---|---|---|
| JP | 08333776 | A | * | 12/1996 | E02F 9/18 |
| JP | 2006-044948 | A | | 2/2006 | |
| JP | 2007-091404 | A | | 4/2007 | |
| JP | 2007162454 | A | * | 6/2007 | E02F 9/18 |
| JP | 2011246926 | A | * | 12/2011 | E02F 9/18 |
| JP | 2013096114 | A | * | 5/2013 | E02F 9/18 |
| JP | 2016160651 | A | * | 9/2016 | B66C 23/74 |
| WO | WO-2013056413 | A1 | * | 4/2013 | B66C 23/74 |

* cited by examiner

COUNTERWEIGHT DEVICE AND CONSTRUCTION MACHINE

RELATED APPLICATIONS

This application claims the Convention priority based on Japanese Patent Application No. 2017-036813 filed on Feb. 28, 2017, the content of which, including the specification, the claims and the drawings, are incorporated herein by reference in their entirety.

BACKGROUND

Technical Field

Certain embodiments of the present invention relate to a counterweight device and a construction machine including the counterweight device.

Description of Related Art

In a construction machine such as a crawler crane, a counterweight is attached to a rear end portion of a machine body frame in order to ensure stability of the machine body when work is carried out. Since the counterweight is heavy, the counterweight is detached from a machine body frame in order to reduce a transport weight when the construction machine is transported. The counterweight is attached to and detached from the machine body frame by using a counterweight device. As the construction machine including the counterweight device, the related art discloses the following known technologies, for example.

In the known technologies, the related art discloses one configuration as follows. A counterweight attachment/detachment unit for attaching the counterweight to a turning frame includes a second frame detachably attached to a first frame and forming the turning frame together with the first frame, and a hydraulic actuator moving so that the counterweight can be attached to the second frame in a state where the second frame is attached to the first frame. The hydraulic actuator pushes up the second frame so as to be attachable to the first frame, and raises the counterweight so as to be attachable to the second frame after the second frame is attached to the first frame. The hydraulic actuator is configured to function as a hydraulic cylinder.

In the known technologies, the related art discloses another configuration of a counterweight device of a construction machine in which a counterweight is attached to a machine body frame of the construction machine. The counterweight device includes a first engagement groove disposed in a counterweight, a second engagement groove disposed in the machine body frame, a first engagement member projecting in the counterweight and engaging with the second engagement groove when the counterweight is attached, a second engagement member projecting in the machine body frame and engaging with the first engagement groove when the counterweight is attached, and fixing means for fixing the counterweight to the machine body frame in a state where the first engagement member engages with the second engagement groove and the second engagement member engages with the first engagement groove.

SUMMARY

According to an embodiment of the present invention, there is provided a counterweight device attachable to a rear end portion of a machine body frame, which includes a mounting table on which a counterweight is mounted, a hydraulic cylinder that raises and lowers the mounting table, and a connection structure that connects the mounting table and a cylinder rod of the hydraulic cylinder, in which stretching and shrinking operations of the cylinder rod enables the mounting table to be supported by the rear end portion. The counterweight device includes a support member that supports the hydraulic cylinder on the mounting table, a first coupling mechanism that couples the connection structure and the rear end portion of the machine body frame to each other, when the cylinder rod is stretched, a second coupling mechanism that couples the support member and the rear end portion of the machine body frame to each other, when the cylinder rod is shrunk, a first operation unit that operates the first coupling mechanism, and a second operation unit that operates the second coupling mechanism. The first coupling mechanism performs the coupling in a rear side center of gravity state where a center of gravity position when the connection structure and the hydraulic cylinder are integrated with each other is located on a side farther away from the machine body frame side than a vertical line passing through the center of the oscillating spindle.

DETAILED DESCRIPTION

Hereinafter, an embodiment according to the present invention will be described with reference to the drawings.

Figure 1:
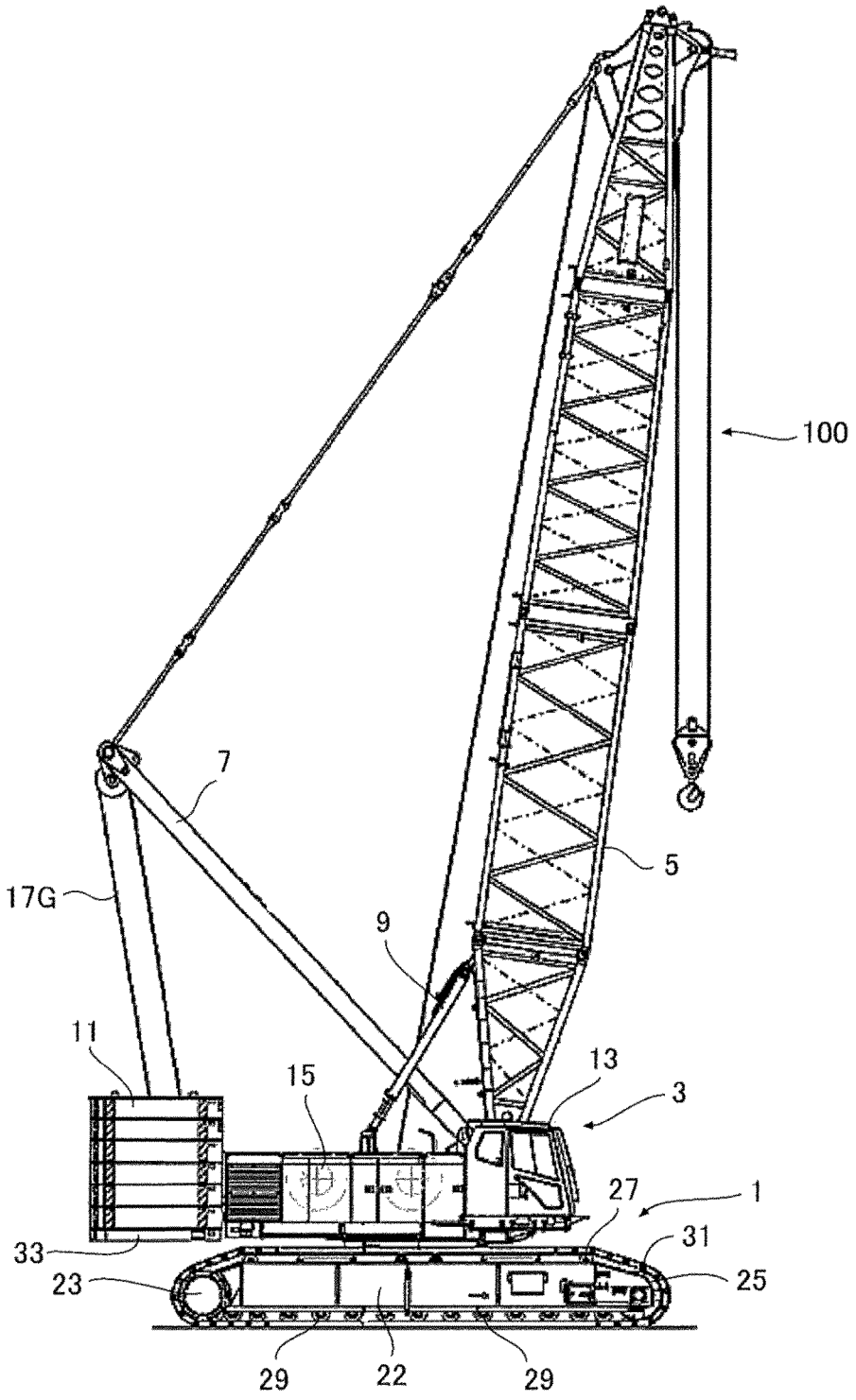
FIG. 1 is a side view illustrating an overall configuration of a crawler crane serving as a construction machine according to an embodiment of the present invention.

FIG. 1 is a view illustrating an overall configuration of a crawler crane serving as a construction machine according to the embodiment of the present invention. In the drawing, a crawler crane 100 including a counterweight attachment/detachment device serving as a counterweight device is basically configured to include a lower traveling body (crawler) 1, an upper turning body 3, a boom 5, a mast 7, a backstop 9, and a counterweight 11. The upper turning body 3 is disposed on the lower traveling body 1 so as to be capable of turning via a turning wheel. The boom 5 is pivotably supported by the upper turning body 3 so as to be capable of derricking. A cab (operator's cab) 13 is installed in an end portion of the upper turning body 3 which is opposite to an installation side of the counterweight 11. A house (machine room) 15 is disposed between the cab 13 and the counterweight 11.

A hoisting drum serving as a hoisting winch drum and a derricking drum 17F (FIGS. 2A to 2C) serving as a derricking winch drum are mounted on the turning frame 17. A hoisting rope is wound around the hoisting drum, and the hoisting rope is wound or unwound by driving the hoisting drum, and a hook suspended from a distal end of the boom 5 is raised and lowered. A derricking rope 17G is wound around the derricking drum 17F, and the derricking rope 17G is wound around or unwound from the derricking drum 17F by driving the derricking drum 17F. In this manner, the boom 5 performs a derricking operation.

A hoisting hydraulic motor and a derricking hydraulic motor are installed inside the turning frame 17. The hoisting drum is driven by the hoisting hydraulic motor, and the derricking drum 17F is driven by the derricking hydraulic motor. A brake device for braking the hoisting hydraulic motor and the derricking hydraulic motor is installed therein so as to control the driving of the hoisting hydraulic motor and the derricking hydraulic motor.

Figure 2B:
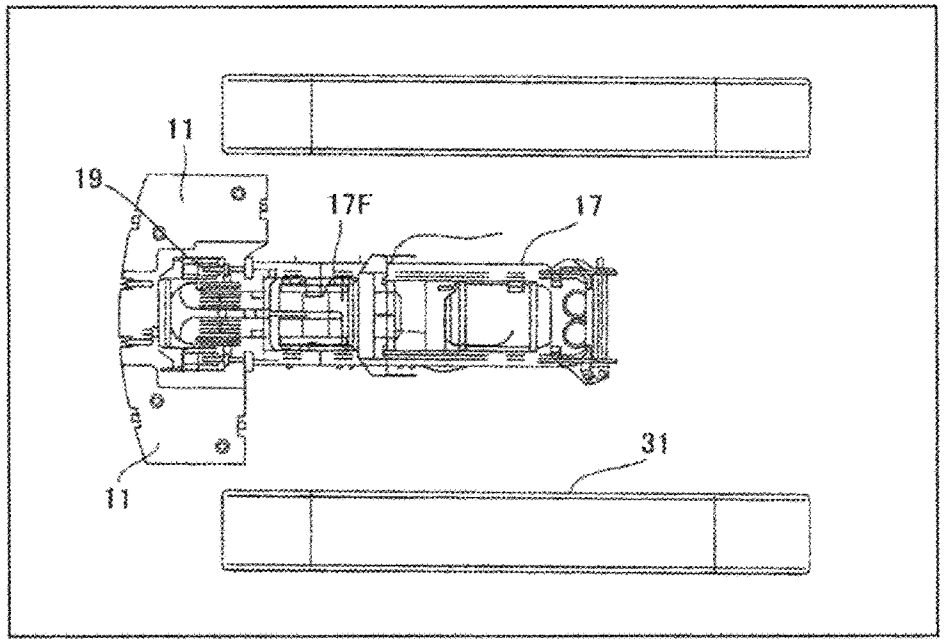
FIGS. 2A to 2C are three orthographic views illustrating a lower traveling body, a turning frame, a counterweight attachment/detachment device, and a counterweight of the crawler crane in FIG. 1.
Figure 2C:
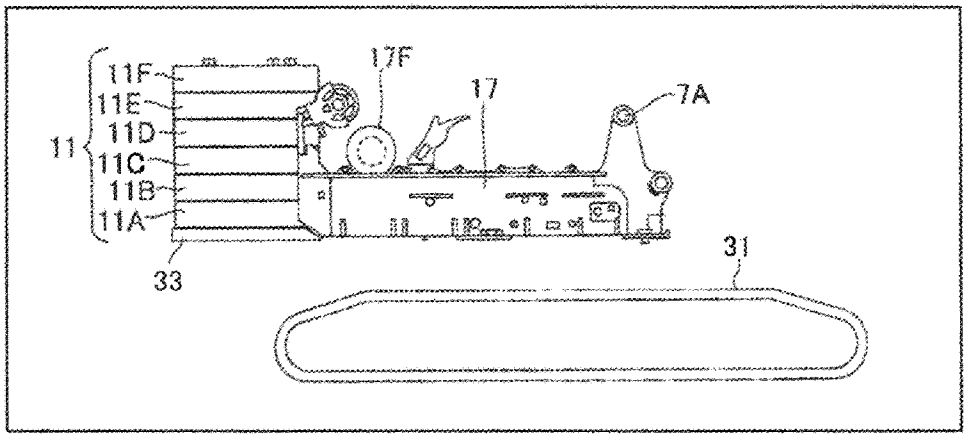
Figure 2A:
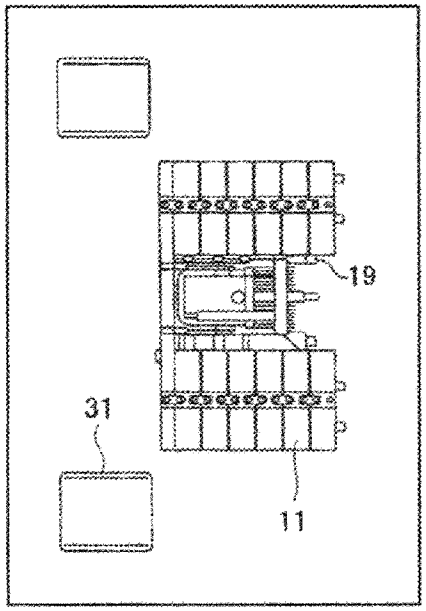

FIGS. 2A to 2C are three orthographic views illustrating the lower traveling body 1, the turning frame 17, the counterweight attachment/detachment device 19, and the counterweight 11 of the crawler crane 100. FIG. 2A is a plan view, FIG. 2B is a side view when FIG. 2A is viewed from a left side, and FIG. 3C is a front view. In FIGS. 2A to 2C, the turning wheel, the cab 13, the mast 7, and the boom 5 are omitted. The turning frame 17 configures a portion of the upper turning body 3.

As illustrated in FIG. 1, the lower traveling body 1 includes a crawler side frame 22, a driving wheel 23, a driven wheel 25, an upper roller 27, a lower roller 29, and a shoe 31. The driving wheel 23 and the driven wheel 25 are disposed in front and rear portions of the crawler side frame 22, and the driving wheel 23 is driven by a traveling device. The lower roller 29 is installed in a lower portion of the crawler side frame 22, and the upper roller 27 is installed in an upper portion of the crawler side frame 22. The shoe 31 is wound around the driving wheel 23, the lower roller 29, the driven wheel 25, and the upper roller 27 so as to configure an endless track. The reference numeral 33 represents a base plate on which the counterweight 11 is mounted.

Figure 3:
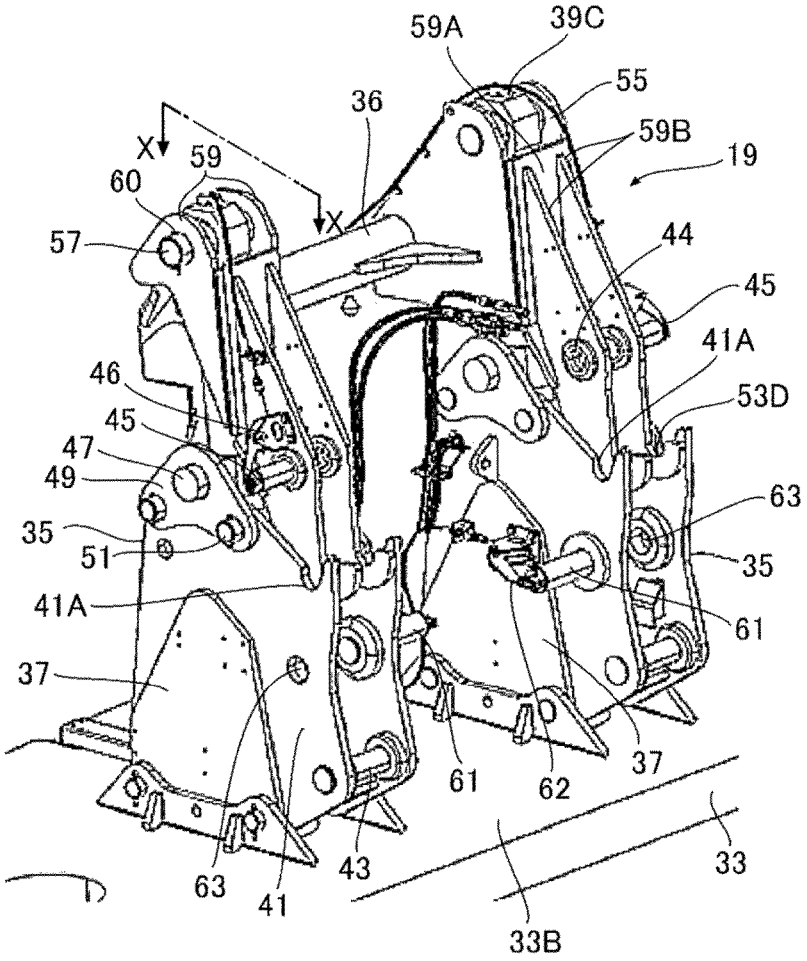
FIG. 3 is a perspective view illustrating a configuration of the counterweight attachment/detachment device in FIGS. 2A to 2C.
Figure 4:
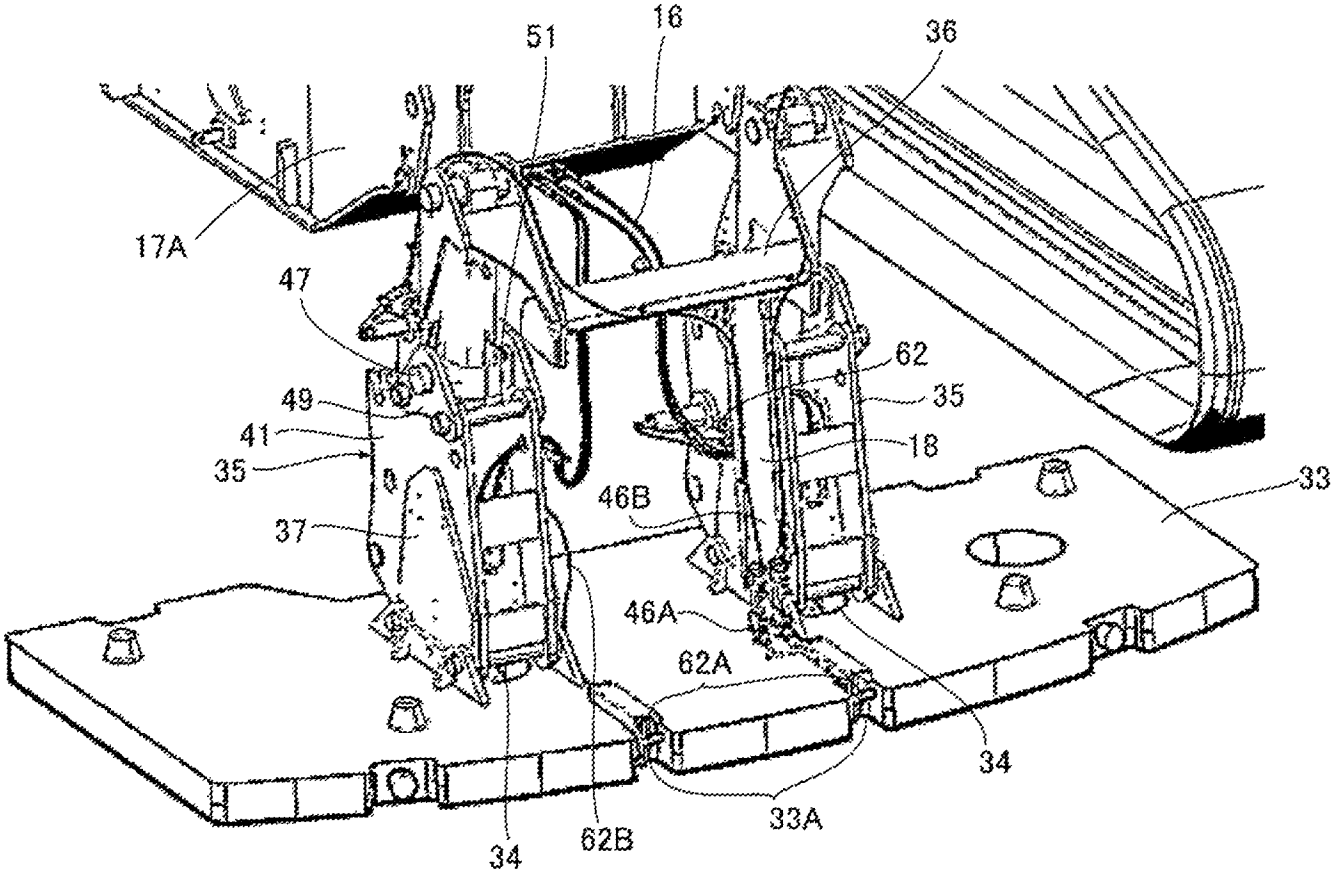
FIG. 4 is a perspective view illustrating a relationship between the counterweight attachment/detachment device and a rear end portion of the turning frame in FIG. 3.
Figure 5:
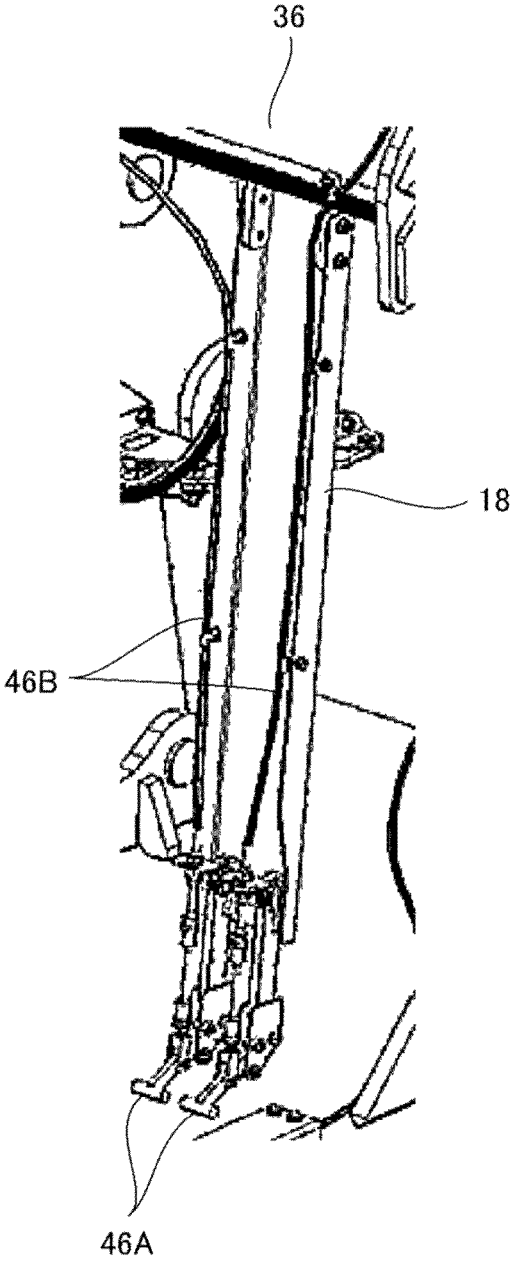
FIG. 5 is a perspective view of a main portion illustrating an operation bracket in FIG. 4.
Figure 6:
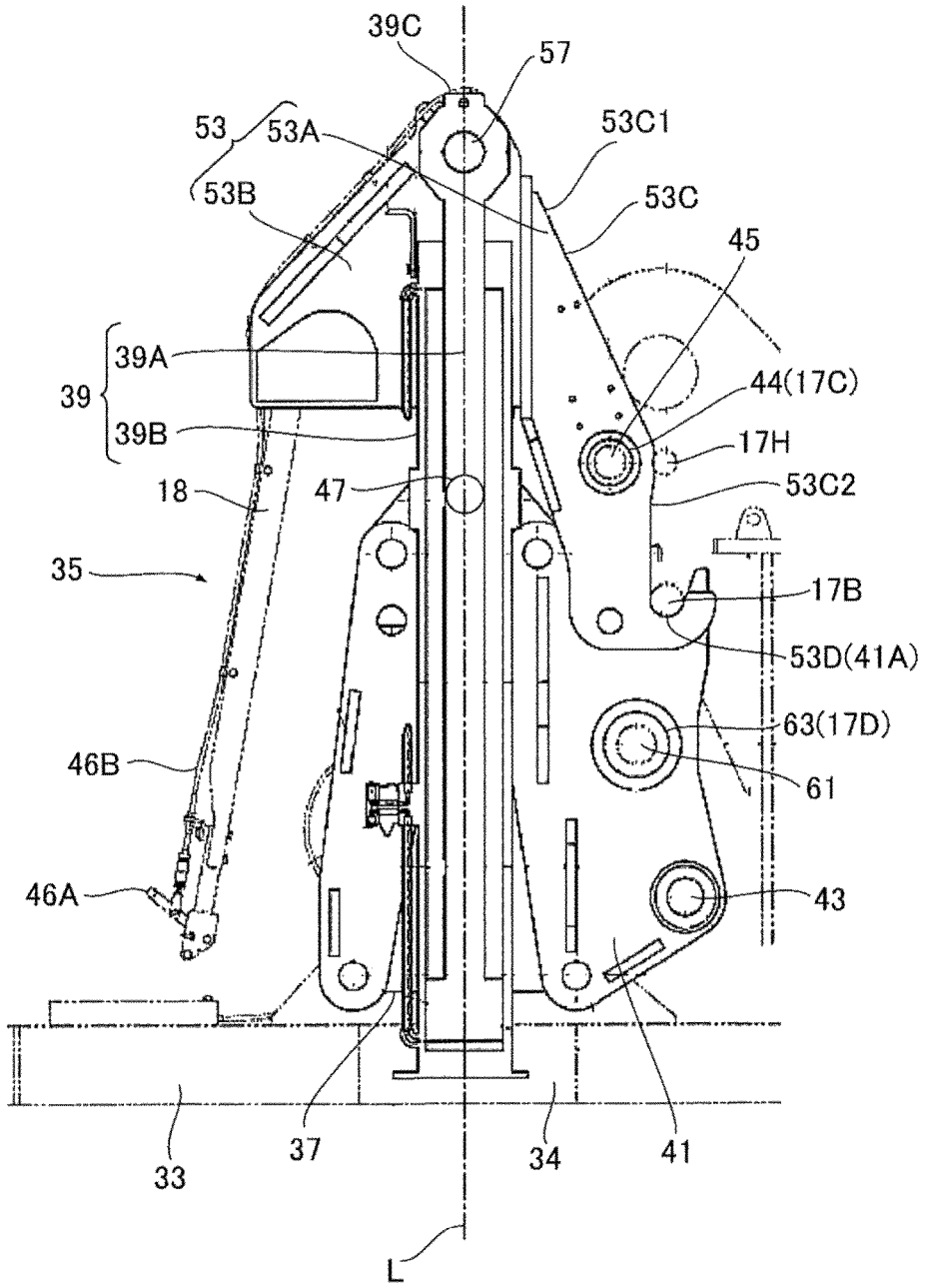
FIG. 6 is a sectional view taken along line X-X in FIG. 3.

FIG. 3 is a perspective view illustrating a configuration of the counterweight attachment/detachment device 19, and is a view when viewed from the turning frame 17 side. FIG. 4 is a perspective view illustrating a relationship between the counterweight attachment/detachment device 19 and a rear end portion 17A of the turning frame 17 in FIG. 3, and is a view when viewed from a rear side of a base plate 33. FIG. 5 is a perspective view of a main portion illustrating an operation bracket 18. FIG. 6 is a sectional view taken along line X-X in FIG. 3.

In FIGS. 3 to 6, the counterweight attachment/detachment device 19 serving as a counterweight device includes a weight raising/lowering unit 35, and the base plate 33 on which the counterweight 11 is mounted. The weight raising/lowering units 35 are laterally symmetrically disposed pair by pair. The counterweight 11 is formed by stacking weight members 11A, 11B, 11C, 11D, 11E and 11F onto one another. The respective weight members 11A to 11F and the base plate 33 are integrally fastened to each other by a link, and are symmetrically arranged on both sides on the base plate 33 (FIGS. 2A to 2C). The respective weight members 11A to 11F are formed in a substantially L-shape from a top view. A pair of right and left counterweights 11 is disposed at a predetermined interval, and a pair of the right and left weight raising/lowering units 35 is disposed in a space between a pair of the counterweights 11.

The weight raising/lowering unit 35 is attached to the base plate 33. A pair of connection plates 37 is respectively and laterally symmetrically erected on an upper surface 33B of the base plate 33. The two connection plates 37 have the same outer shape, and are respectively arranged parallel to a plane orthogonal to a forward-rearward direction. As illustrated in FIG. 6, a pair of opening portions 34 is formed in the base plate 33, and a pair of the connection plates 37 is respectively fixed across the opening portions 34.

As illustrated in FIG. 6, the weight raising/lowering unit 35 includes a hydraulic cylinder 39 and a pair of support brackets 41 respectively connecting the hydraulic cylinder 39 to the base plate 33 via a pair of the connection plates 37. The hydraulic cylinder 39 includes a cylinder rod 39A and a cylinder tube 39B through which pressure oil is supplied and discharged so as to stretch and shrink the cylinder rod 39A in an upward-downward direction. The support bracket 41 has a pair of right and left plates, and a pair of the plates is respectively coupled to and integrated with each other by a plurality of pins including a support bracket connection pin 43. A pair of the right and left plates of the support bracket 41 is disposed at a predetermined interval, and the hydraulic cylinder 39 is disposed between a pair of the plates.

In the support bracket 41, a second fixing pin 61 for fixing the rear end portion 17A of the turning frame 17 (to be described later) is removably disposed by a second fixing pin insertion/removal mechanism 62. Furthermore, the support bracket 41 is provided with a support groove 41A which supports a guide pin 17B disposed in a central portion of the rear end portion 17A of the turning frame 17 (to be described later). The support groove 41A is open upward, and has a function to locate a guide pin 17B guided from an upper opening portion on a lower bottom portion and to support the guide pin 17B by using the support bracket 41. The weight raising/lowering unit 35 is provided with a pair of symmetrical raising/lowering mechanisms having the configuration illustrated in FIG. 3. Hereinafter, the same reference numerals will be given to the same configuration elements for a pair of weight raising/lowering units 35, and both of these will be described without any particular distinction.

As described above, the hydraulic cylinder 39 is connected to the base plate 33 via a pair of the support brackets 41 and a pair of the connection plates 37. In this case, the cylinder tube 39B of the hydraulic cylinder 39 is disposed between a pair of the right and left connection plates 37, and is respectively supported by a pair of the support brackets 41. The cylinder rod 39A of the hydraulic cylinder 39 is stretched upward with respect to the cylinder tube 39B, and is shrunk downward. Pressure oil is supplied to the cylinder tube 39B from the turning frame 17 via a hydraulic hose 16, and the cylinder rod 39A performs stretching and shrinking operations.

On an upper portion side of the cylinder tube 39B of the hydraulic cylinder 39, trunnions 47 respectively protrude in a direction perpendicular to a plate surface of a pair of the support brackets 41. A substantially triangular attachment plate 49 is attached to an upper end portion of the support bracket 41 via an attachment pin 51. An attachment hole is disposed in the center of the attachment plate 49. The trunnion 47 of the cylinder tube 38B is inserted into the attachment hole so that the hydraulic cylinder 39 is supported by a pair of the support brackets 41 pivotable in the forward-rearward direction of the turning frame 17.

A detachable frame attachment pin 57 for integrally coupling a pin to a rod end coupling portion 55 of a detachable frame 53 is attached to a cylinder top 39C in a distal end of the cylinder rod 39A. As illustrated in FIG. 3, the detachable frame attachment pin 57 is disposed so as to penetrate a through hole 60 disposed in an upper portion of right and left plate members 59 of the detachable frame 53, and the detachable frame 53 is fixed to the cylinder top 39C. The detachable frame 53 has a front side portion 53A closer to the rear end portion 17A side of the turning frame 17 than the cylinder rod 39A and a rear side portion 53B farther from the rear end portion 17A side than the cylinder rod 39A. The front side portion 53A has a guide surface 53C for guiding the guide pin 17B to a guide groove 53D. As can be understood from FIG. 6, the guide surface 53C has an upper guide surface 53C1 whose lower side is inclined with respect to a vertical line L (virtual line) (FIGS. 6 and 7C) in a direction away from the vertical line L when an axis of the cylinder rod 39A coincides with the vertical line L passing through the center of the trunnion 47, and a lower guide surface 53C2 which is continuous with the upper guide surface 53C1 and which is parallel to the vertical line L.

A member 36 is disposed so as to couple rear side portions 53B of a pair of the detachable frames 53 to each other. A function of the member 36 is to couple the rear side portions 53B of a pair of the detachable frames 53. Moreover, the member 36 has a function to adjust a center of gravity position so that a center of gravity of the detachable frame 53 supported by the trunnion 47 passing through the center of the trunnion 47 is located on aside farther from the rear end portion 17A of the turning frame 17 than the vertical line L, that is, on the rear side. In this manner, the detachable frame 53 is supported by the trunnion 47 on a rear side center of gravity. Hereinafter, in the description herein, the front side means a side close to the turning frame 17, and the rear side means a side far from the turning frame 17.

Figure 7A:
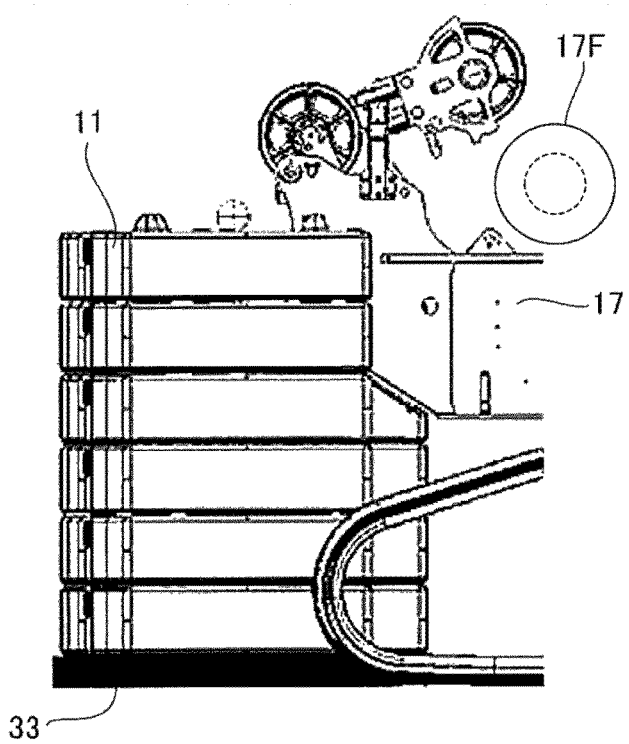
FIG. 7A is an operation diagram illustrating a counterweight attachment/detachment operation of the counterweight attachment/detachment device, and illustrates a state when the counterweight attachment/detachment device and the rear end portion of the turning frame are aligned with each other.
Figure 7B:
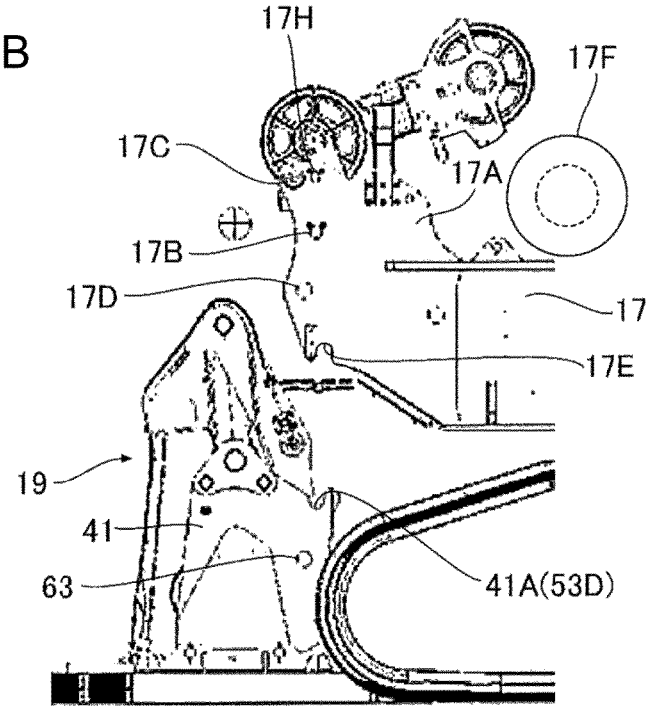
FIG. 7B is an operation diagram illustrating a counterweight attachment/detachment operation of the counterweight attachment/detachment device, and illustrates a state where the counterweight in FIG. 7A is omitted.
Figure 7C:
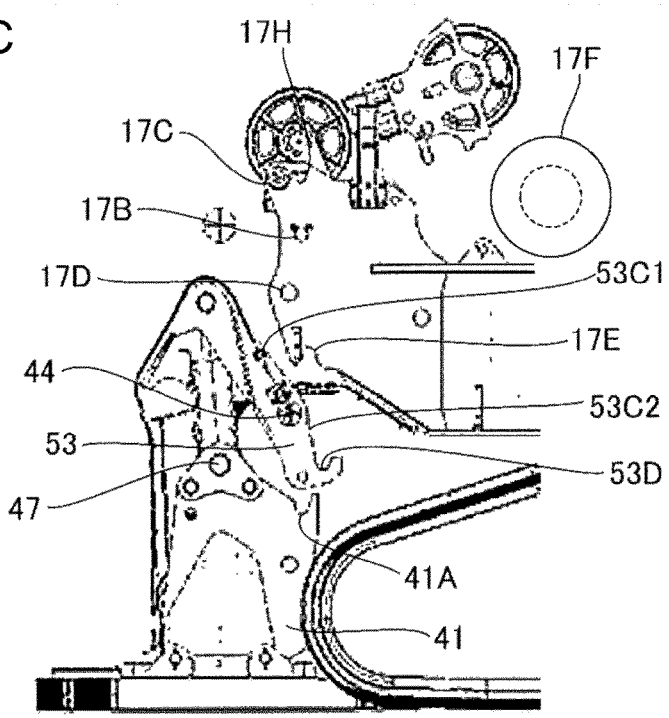
FIG. 7C is an operation diagram illustrating a counterweight attachment/detachment operation of the counterweight attachment/detachment device, and illustrates a state when a cylinder rod of a hydraulic cylinder is stretched.

If the hydraulic cylinder 39 is supported at the rear side center of gravity, the hydraulic cylinder 39 is rotated around the center of the trunnion 47, and stops at a position balanced at the rear side center of gravity (FIG. 7C). At this stop position, the lower guide surface 53C2 is also inclined up to a position inclined with respect to the vertical line L, and stops at the balanced position. If the lower guide surface 53C2 stops at this position, a guide range of the guide surface 53C which guides the guide pin 17B is widened, thereby enabling an error allowable range to be widened when the guide surface 53C receives and guides the guide pin 17B. The member 36 only needs to have strength enough to couple the rear side portions 53B of a pair of the detachable frames 53 and to bring both of these into a juxtaposed state, and a weight enough to locate the detachable frame 53 at the rear side center of gravity. Accordingly, compared to the example in the related art, it is possible to significantly reduce the weight of the counterweight attachment/detachment device 19.

As illustrated in FIGS. 3 and 4, a front side portion 53A of the detachable frame 53 fixes a support member 59A to a front side portion of a pair of right and left plate members 59 having the same shape, and a pair of guide plates 59B having the same shape is disposed parallel to each other with respect to the support member 59A. In this manner, the front side portion 53A is vertically fixed to and integrated with the support member 59A. The guide plate 59B has a first fixing pin insertion hole 44 formed in the vicinity of a portion switched from the upper guide surface 53C1 to the lower guide surface 53C2. As illustrated in FIG. 3, a first fixing pin insertion/removal mechanism 46 for inserting and removing a first fixing pin 45 is disposed outside the guide plate 59B at a location having the first fixing pin insertion hole 44 formed therein. The first fixing pin insertion hole 44 and the first fixing pin insertion/removal mechanism 46 are installed in each of a pair of the weight raising/lowering units 35. The first fixing pin 45 is inserted inward from the outside, and is removed outward from the inside by the first fixing pin insertion/removal mechanism 46.

Figure 7D:
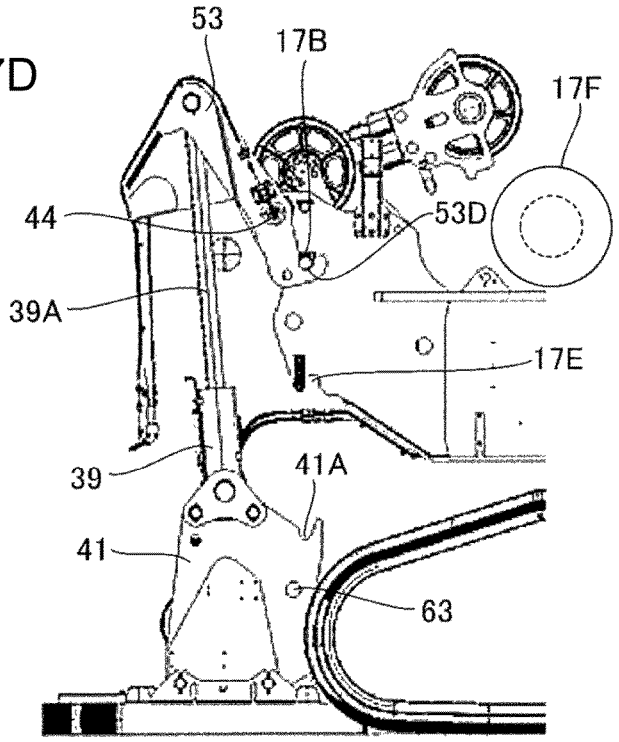
FIG. 7D is an operation diagram illustrating a counterweight attachment/detachment operation of the counterweight attachment/detachment device, and illustrates a state where the cylinder rod is stretched and a guide pin is fitted into a guide groove.
Figure 7E:
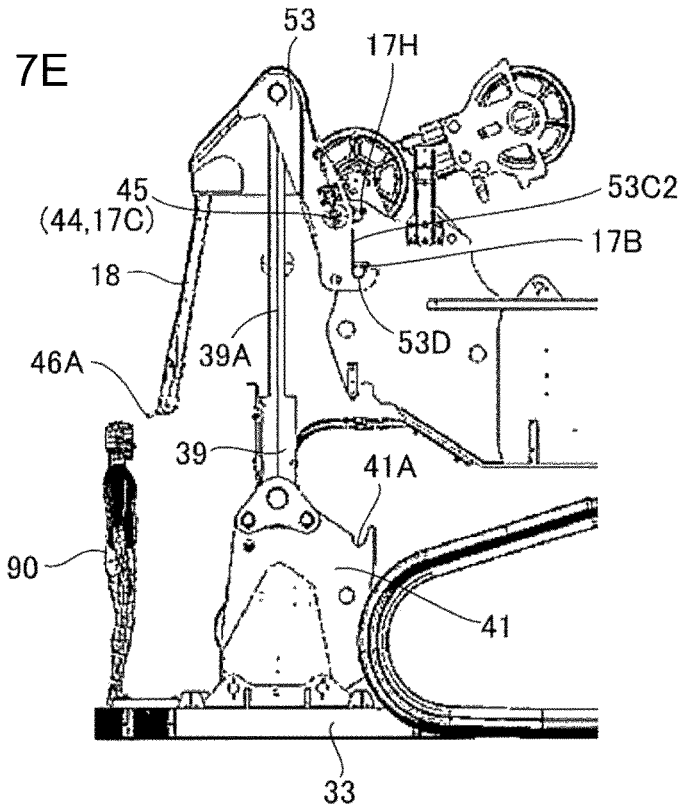
FIG. 7E is an operation diagram illustrating a counterweight attachment/detachment operation of the counterweight attachment/detachment device, and illustrates a state where the cylinder rod is further stretched and a weight raising/lowering unit is rotated in a clockwise direction.
Figure 8:
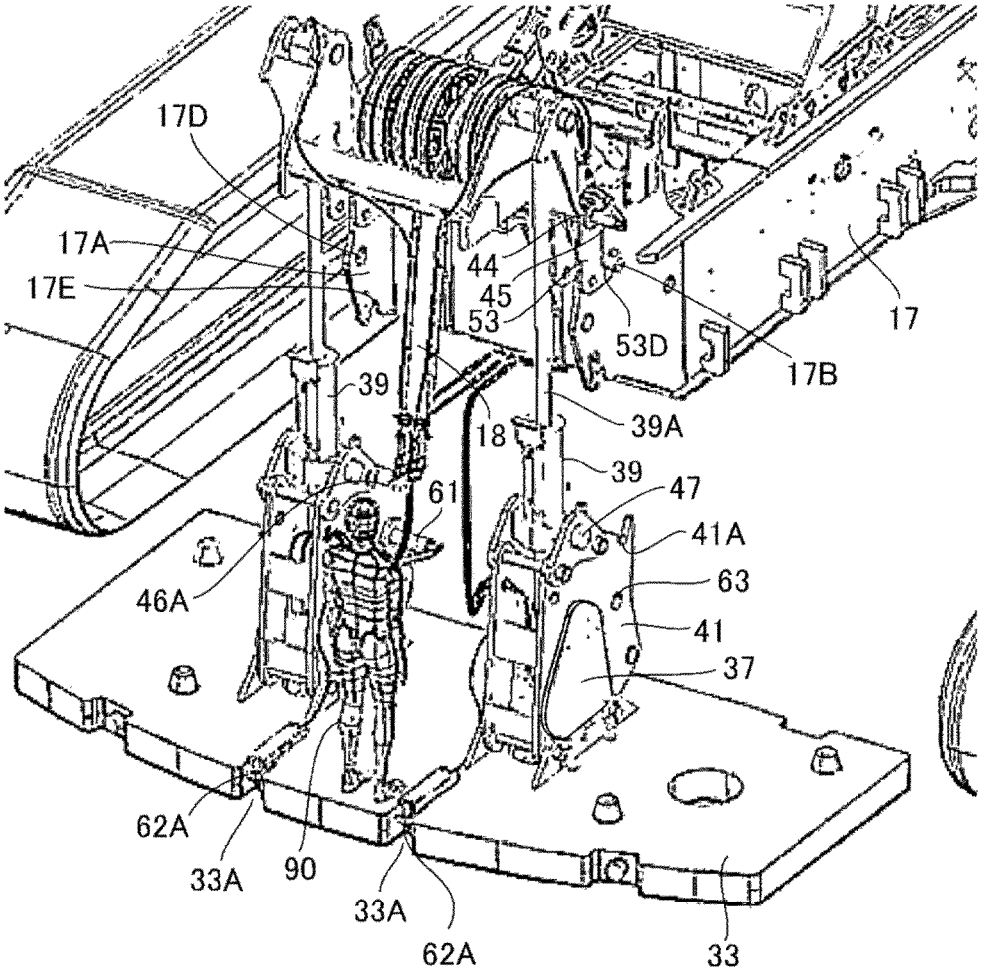
FIG. 8 is a perspective view when a state illustrated in FIG. 7E is viewed from a right rear side of the counterweight attachment/detachment device.

The first fixing pin 45 fixes the detachable frame 53 to the rear end portion 17A of the turning frame 17. The first fixing pin 45 is operated by a pair of first operation levers 46A disposed in a lower end of the operation bracket 18 as illustrated in FIGS. 4, 5 and 6. The first operation lever 46A (to be described later) inserts and removes the first fixing pin 45 into and from the first fixing pin insertion hole 44 by causing a first push-pull wire 46B to drive the first fixing pin insertion/removal mechanism 46. The operation bracket 18 is installed obliquely downward from the member 36. A position and a length of the operation bracket 18 are set to a position and a height which enable the first operation lever 46A to be comfortably operated in a state where a worker 90 stands on the base plate 33 (FIGS. 7E and 8).

In addition to the first fixing pin 45, the weight raising/lowering unit 35 is provided with a second fixing pin 61 and a second fixing pin insertion/removal mechanism 62 for fixing the support bracket 41 to the rear end portion 17A of the turning frame 17. On the other hand, a pair of the support brackets 41 has a second fixing pin insertion hole 63 for inserting and removing the second fixing pin 61. The second fixing pin insertion hole 63 is disposed in a substantially central portion in a height direction of an installation location of the support bracket connection pin 43 and the trunnion 47. The second fixing pin 61 and the second fixing pin insertion/removal mechanism 62 are respectively arranged at symmetrical positions inside a pair of the weight raising/lowering units 35. The second fixing pin 61 is inserted outward from the inside, and is removed inward from the outside.

As illustrated in FIG. 4, the rear end portion of the base plate 33 is provided with a pair of second operation levers 62A for operating the second fixing pin insertion/removal mechanism 62. Similar to the first fixing pin insertion/removal mechanism 46, the second fixing pin insertion/removal mechanism 62 causes a second push-pull wire 62B to drive the second fixing pin insertion/removal mechanism 62 so that the second fixing pin 61 is inserted into and removed from the second fixing pin insertion hole 63. The second operation lever 62A is installed inside a cutout portion 33A formed by cutting out the rear end portion of the base plate 33 so as not to protrude from the rear end of the counterweight and not to be carelessly operated. The reference numeral 17D illustrated in FIG. 6 represents a second fixing pin receiving hole on the rear end portion 17A side of the turning frame 17, into which the second fixing pin 61 is inserted. The reference numeral 17C represents a first fixing pin receiving hole on the rear end portion 17A side of the turning frame 17, into which the first fixing pin 45 is inserted. A stopper pin 17H for restricting the rotation of the detachable frame 53 protrudes on the side of the first fixing pin receiving hole 17C in order to align the first fixing pin receiving hole 17C and the first fixing pin insertion hole 44 with each other.

FIGS. 7A to 7H are operation diagrams illustrating counterweight attachment/detachment operations of the counterweight attachment/detachment device 19. A portion appearing on the upper right in FIG. 7B is the rear end portion 17A of the turning frame 17 of the crawler crane 100. In the rear end portion 17A, the first fixing pin receiving hole 17C is disposed above, the guide pin 17B is disposed below the first fixing pin receiving hole 17C, and the second fixing pin receiving hole 17D is disposed below the guide pin 17B. The lower end of the rear end portion 17A is provided with a positioning groove 17E for positioning the support bracket 41 and the rear end portion 17A of the turning frame 17 by engaging with the support bracket connection pin 43 from above. The second fixing pin receiving hole 17D is formed at a position coincident with the second fixing pin insertion hole 63 when the positioning groove 17E engages with the support bracket connection pin 43. If the second fixing pin 61 is inserted into the second fixing pin insertion hole 63 at this position, the second fixing pin 61 passes through the second fixing pin receiving hole 17D, and reaches the second fixing pin insertion hole 63 located on the opposite side. In this manner, the weight raising/lowering unit 35 and the turning frame 17 can be integrated with each other.

The guide pin 17B disposed in the rear end portion 17A of the turning frame 17 is used for positioning the turning frame 17 and the detachable frame 53. That is, if the guide pin 17B engages with the guide groove 53D and a load is applied to the detachable frame 53, the weight raising/lowering unit 35 is rotated around the trunnion 47 in a clockwise direction in the drawing. In this process, three positions are determined so that there is a position where the first fixing pin receiving hole 17C and the first fixing pin insertion hole 44 coincide with each other, and the guide pin 17B is used for this positioning. In FIGS. 7A to 7H, a device appearing on the right side of the rear end portion 17A of the turning frame 17 is the derricking drum 17F (FIG. 2A to 2C).

In a case where the counterweight 11 is attached to the rear end portion 17A of the turning frame 17 by the counterweight attachment/detachment device 19, as illustrated in FIG. 7A, the counterweight attachment/detachment device 19 and the rear end portion 17A of the turning frame 17 are first aligned with each other. When the alignment is performed, the crawler crane 100 is moved rearward, and the rear end portion 17A of the turning frame 17 is located at a position facing the detachable frame 53. In this case, the weight raising/lowering unit 35 of the counterweight attachment/detachment device 19 is in an initial state, and the cylinder rod 39A of the hydraulic cylinder 39 is in a most shrunk state. FIG. 7B is a diagram illustrating a relationship between the rear end portion 17A and the counterweight attachment/detachment device 19 when the alignment is performed, and the counterweight 11 is omitted in the drawing. In FIGS. 7C to 7G, the counterweight 11 is also omitted in the drawing.

If the positional relationship is completely adjusted between the rear end portion 17A and the counterweight attachment/detachment device 19 in FIG. 7B, the cylinder rod 39A of the hydraulic cylinder 39 is stretched as illustrated in FIG. 7C, and the guide groove 53D of the detachable frame 53 engages with the guide pin 17B of the rear end portion 17A of the turning frame 17. In this case, if the guide pin 17B is located in the upper portion of the upper guide surface 53C1 and the lower guide surface 53C2 of the detachable frame 53, along with the stretching operation of the hydraulic cylinder 39, the guide pin 17B comes into contact with either the upper guide surface 53C1 or the lower guide surface 53C2. The guide pin 17B is then guided along the upper guide surface 53C1 and the lower guide surface 53C2 or along the lower guide surface 53C2, and is fitted into the guide groove 53D as illustrated in FIG. 7D. The hydraulic cylinder 39 is stretched and shrunk by controlling the pressure oil supplied to the hydraulic cylinder 39 from a hydraulic pump installed in a house 15 of the turning frame 17 via the hydraulic hose 16. The pressure oil is controlled by operating an operation lever inside the cab 13 to control a directional control valve.

In a state illustrated in FIG. 7D, the guide pin 17B is merely fitted into the guide groove 53D, and positions of the first fixing pin insertion hole 44 and the first fixing pin receiving hole 17C do not coincide with each other. Therefore, as illustrated in FIG. 7E, the cylinder rod 39A of the hydraulic cylinder 39 is further stretched. In this manner, the weight raising/lowering unit 35 is rotated around the trunnion 47 in the clockwise direction in the drawing. If the lower guide surface 53C2 of the detachable frame 53 comes into contact with the stopper pin 17H, the stretching operation of the cylinder rod 39A is stopped. As a result, the rotation of the detachable frame 53 is stopped. In this state, the positions of the first fixing pin insertion hole 44 and the first fixing pin receiving hole 17C coincide with each other. Therefore, the first fixing pin 45 is inserted into the first fixing pin receiving hole 17C from the first fixing pin insertion hole 44 side by the first fixing pin insertion/removal mechanism 46, and the weight raising/lowering unit 35 is attached to the rear end portion 17A of the turning frame 17. In this manner, the detachable frame 53 of the weight raising/lowering unit 35 and the turning frame 17 are integrated with each other.

A mechanism and an operation of the first fixing pin insertion/removal mechanism 46 will be described later with reference to FIGS. 9A and 9B. As illustrated in FIG. 7E, the first operation lever 46A included in the lower end of the operation bracket 18 is operated downward, and a spindle 46C (FIG. 9B) is moved in a counterclockwise direction in the drawing. In this manner, the first fixing pin 45 is inserted into the first fixing pin insertion hole 44 by the operation of the first push-pull wire 46B. This pin coupling causes the detachable frame 53 and the rear end portion 17A of the turning frame 17 to be coupled to each other, and the detachable frame 53 is attached to the turning frame 17 side.

Figure 7F:
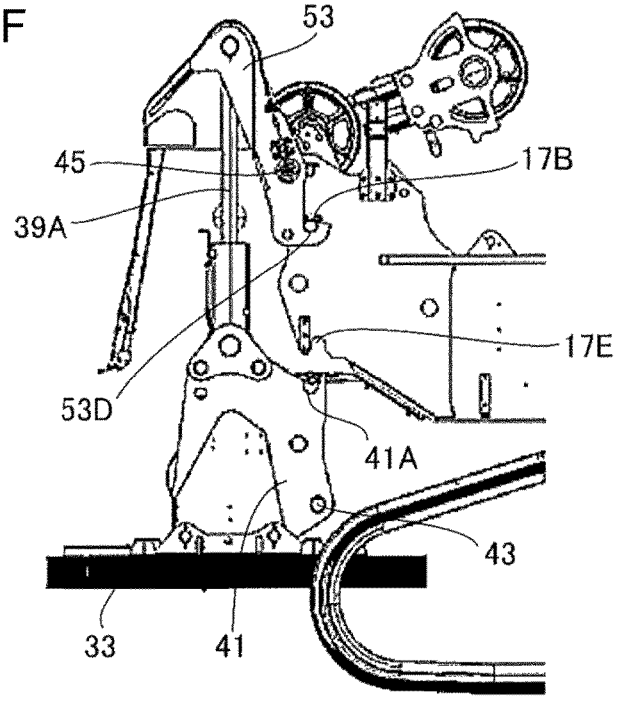
FIG. 7F illustrates an operation diagram illustrating a counterweight attachment/detachment operation of the counterweight attachment/detachment device, and illustrates a state when the cylinder rod is shrunk so as to raise a base plate and the counterweight.
Figure 7G:
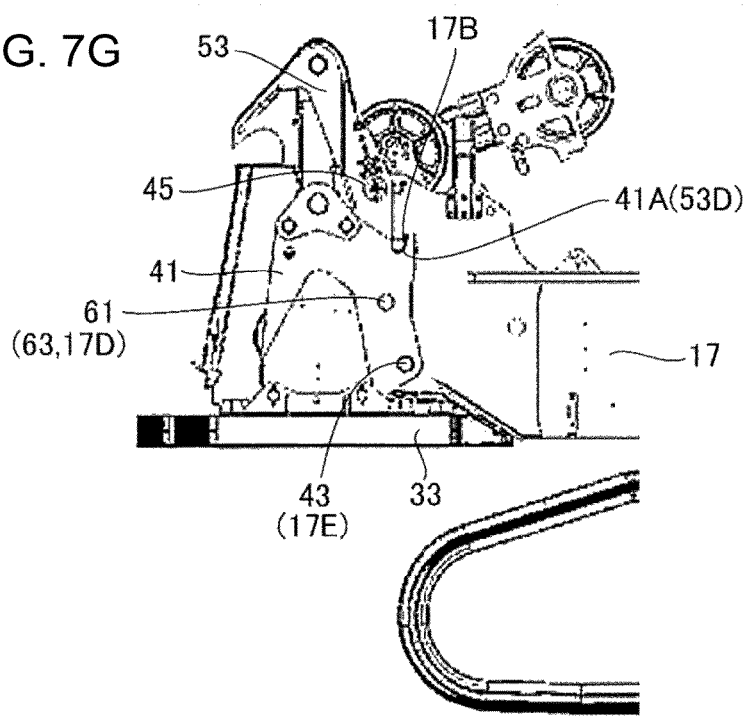
FIG. 7G is an operation diagram illustrating a counterweight attachment/detachment operation of the counterweight attachment/detachment device, and illustrates a state where a positioning groove engages with a support bracket connection pin in a process of shrinking the cylinder rod and a guide pin is fitted into a support groove.
Figure 7H:
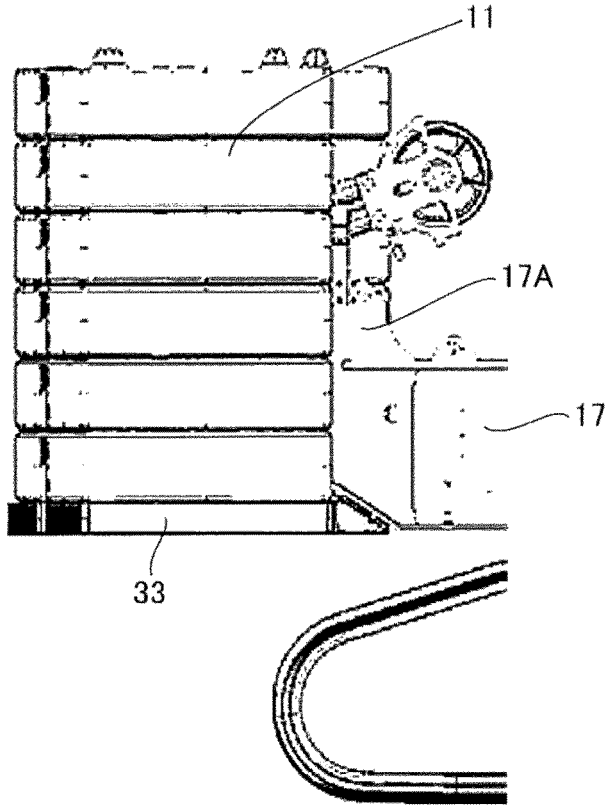
FIG. 7H is an operation diagram illustrating a counterweight attachment/detachment operation of the counterweight attachment/detachment device, and illustrates a state where the counterweight is fixed to the rear end portion of the turning frame.

Thereafter, as illustrated in FIG. 7F, the cylinder rod 39A of the hydraulic cylinder 39 is shrunk, and the base plate 33 and the counterweight 11 fixed onto the base plate 33 are raised. In this process, the positioning groove 17E engages with the support bracket connection pin 43 as illustrated in FIG. 7G, and the guide pin 17B fitted into the guide groove 53D is fitted into the support groove 41A. In this state, the second fixing pin insertion hole 63 and the second fixing pin receiving hole 17D coincide with each other. Therefore, the second operating pin insertion/removal mechanism 62 is driven by operating the second operation lever 62A, and the second fixing pin 61 is inserted from the second fixing pin insertion hole 63 via the second fixing pin receiving hole 17D into the second fixing pin insertion hole 63 located on the opposite side. In this manner, the support bracket 41 and the rear end portion 17A of the turning frame 17 are integrated with each other. As a result, the counterweight 11 is fixed to the rear end portion 17A of the turning frame 17 as illustrated in FIG. 7H.

FIG. 8 is a perspective view when a state illustrated in FIG. 7E is viewed from the right rear side of the counterweight attachment/detachment device 19. In this state, the base plate 33 is located on the ground. In a state where the guide pin 17B is fitted into the guide groove 53D, the cylinder rod 39A of the hydraulic cylinder 39 awaits an operation for inserting the first fixing pin 45 into the first fixing pin insertion hole 44. The worker 90 stands in the center rear portion of the base plate 33. At this position, a hand of the worker 90 easily reaches the first operation lever 46A when the worker 90 stretches out his or her hand in a standing state. In this way, in the present embodiment, the insertion/removal operation of the first fixing pin 45 can be performed by a remote operation of the worker 90 standing on the base plate 33 located on the ground. As a result, a ladder and an upper step of the ladder are not required. The worker 90 does not need to climb up the ladder to carry out work at a high place. Therefore, the present embodiment can contribute to work safety.

Figure 9A:
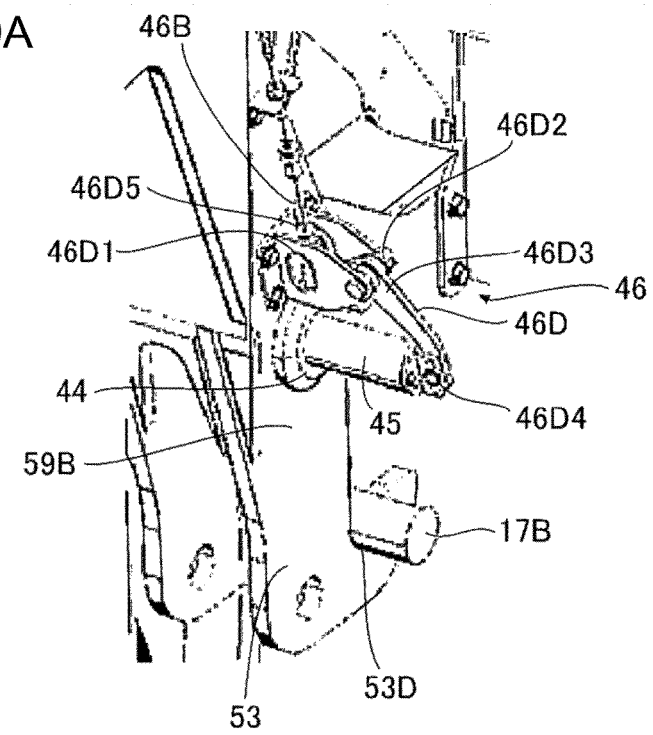
FIG. 9A is a perspective view illustrating the vicinity of a first fixing pin installation portion when a pin of a first fixing pin insertion/removal mechanism for inserting and removing a first fixing pin is not fixed.
Figure 9B:
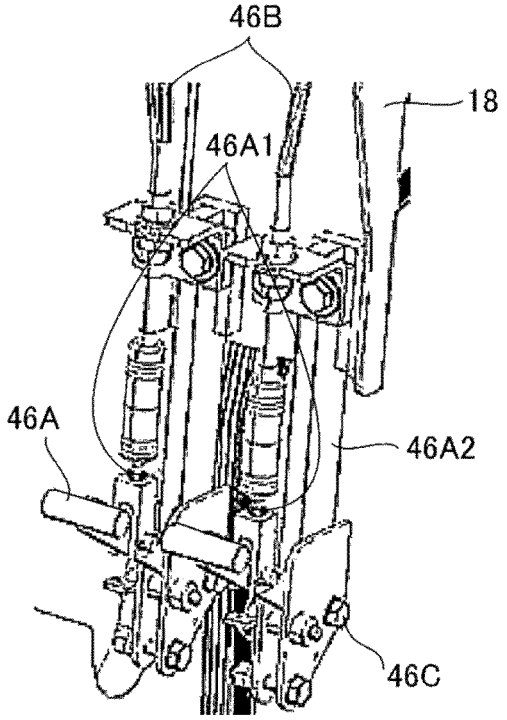
FIG. 9B is a perspective view illustrating the vicinity of a first operation lever installation portion when the pin of the first fixing pin insertion/removal mechanism for inserting and removing the first fixing pin is not fixed.
Figure 10A:
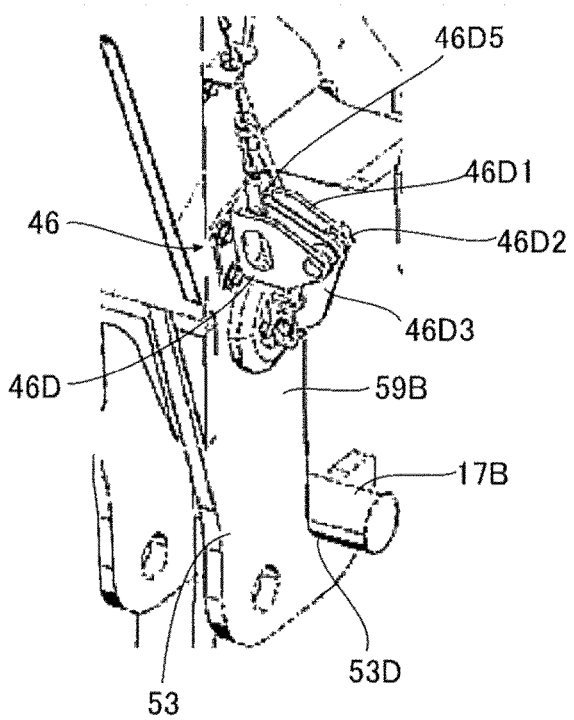
FIG. 10A is a perspective view illustrating the vicinity of the first fixing pin installation portion when the pin of the first fixing pin insertion/removal mechanism for inserting and removing the first fixing pin is fixed.

FIGS. 9A, 9B, 10A, and 10B are perspective views illustrating a main portion of the first fixing pin insertion/removal mechanism 46 for inserting and removing the first fixing pin 45. FIGS. 9A and 10A respectively illustrate the vicinity of an installation portion of the first fixing pin 45, and FIGS. 9B and 10B respectively illustrate the vicinity of an installation portion of the first operation lever 46A for operating the first fixing pin insertion/removal mechanism 46. The first fixing pin insertion/removal mechanism 46 is basically configured to include a first link 46D, a first push-pull wire 46B, and a first operation lever 46A. One end of the first push-pull wire 46B is connected to a connection terminal 46D5 of a first lever 46D3 of the first link 46D, and the other end is connected to a connection terminal 46A1 of the first operation lever 46A.

The first link 46D is supported by a first link bracket 46D1 installed on an outer surface of the guide plate 59B. The first lever 46D3 is an L-shaped member supported by the first link bracket 46D1 via the spindle 46D2 so as to be capable of oscillating. The first push-pull wire 46B is connected to a connection terminal 46D5 which is an end portion of the first lever 46D3 on the guide plate 59B side, and an operating end 46D4 which is an end portion of the first lever 46D3 on a side protruding from the first link bracket 46D1 is pivotably attached to an end portion of the first fixing pin 45 by using a pin or a shaft member.

As illustrated in FIG. 8, the first push-pull wire 46B passes through the upper portion of the detachable frame 53, and is connected to the connection terminal 46A1 of the first operation lever 46A in a terminal end of the operation bracket 18 through the operation bracket 18. The first operation lever 46A is attached to the operation bracket 18 so as to be capable of oscillating with respect to the spindle 46C via a first operation lever support bracket 46A2. FIGS. 9A and 9B illustrate a state where the first fixing pin 45 is not inserted, that is, a state where the pin is not fixed. In this state, as illustrated in FIG. 9B, the first operation lever 46A is located at an upper position.

Figure 10B:
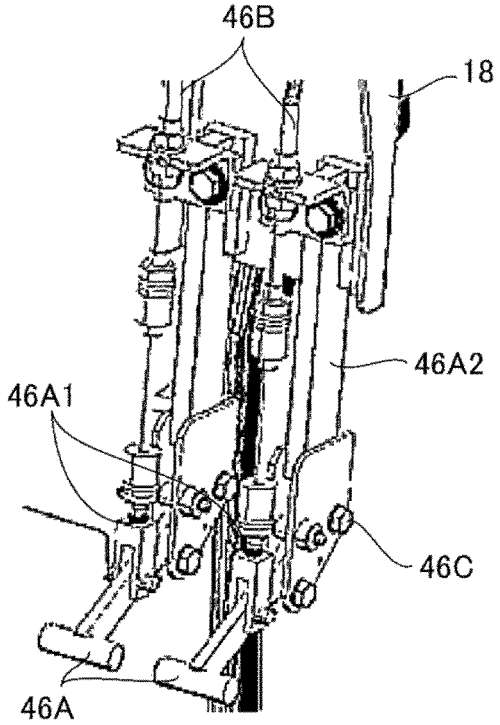
FIG. 10B is a perspective view illustrating the vicinity of the first operation lever installation portion when the pin of the first fixing pin insertion/removal mechanism for inserting and removing the first fixing pin is fixed.

If this state is brought into a state illustrated in FIG. 10B by pulling the first operation lever 46A downward, the first push-pull wire 46B connected to the connection terminal 46A1 is pulled, and the connection terminal 46D5 of the first lever 46D3 of the first link 46D is moved upward in the drawing. In this manner, the first lever 46D3 is rotated in the clockwise direction in the drawing. As a result, as illustrated in FIG. 10A, the operating end 46D4 of the first lever 46D3 pushes the first fixing pin 45 into the first fixing pin insertion hole 44. As described above, the detachable frame 53 is coupled to the rear end portion 17A of the turning frame 17. As a result, both of these are integrated with each other by the first fixing pin 45.

On the other hand, if the first operation lever 46A is raised upward in a state illustrated in FIG. 10B, the first push-pull wire 46B is pushed back, and the first lever 46D3 pivots in the counterclockwise direction with respect to the spindle 46D2. In this manner, the first fixing pin 45 is removed from the first fixing pin insertion hole 44, and a state illustrated in FIG. 9A is obtained. In this case, the first operation lever 46A is in a state where the pin is not fixed in FIG. 9B. In FIGS. 9B and 10B, a pair of the first operation levers 46A is disposed on the right and left, and only the mechanism on the right side in the drawing is illustrated in the first fixing pin insertion/removal mechanism 46. However, the first fixing pin insertion/removal mechanism 46 on the left side which is driven by the first operation lever 46A on the left side is also disposed symmetrically with the first fixing pin insertion/removal mechanism 46 on the right side, and is similarly operated, as a matter of course.

Figure 11:
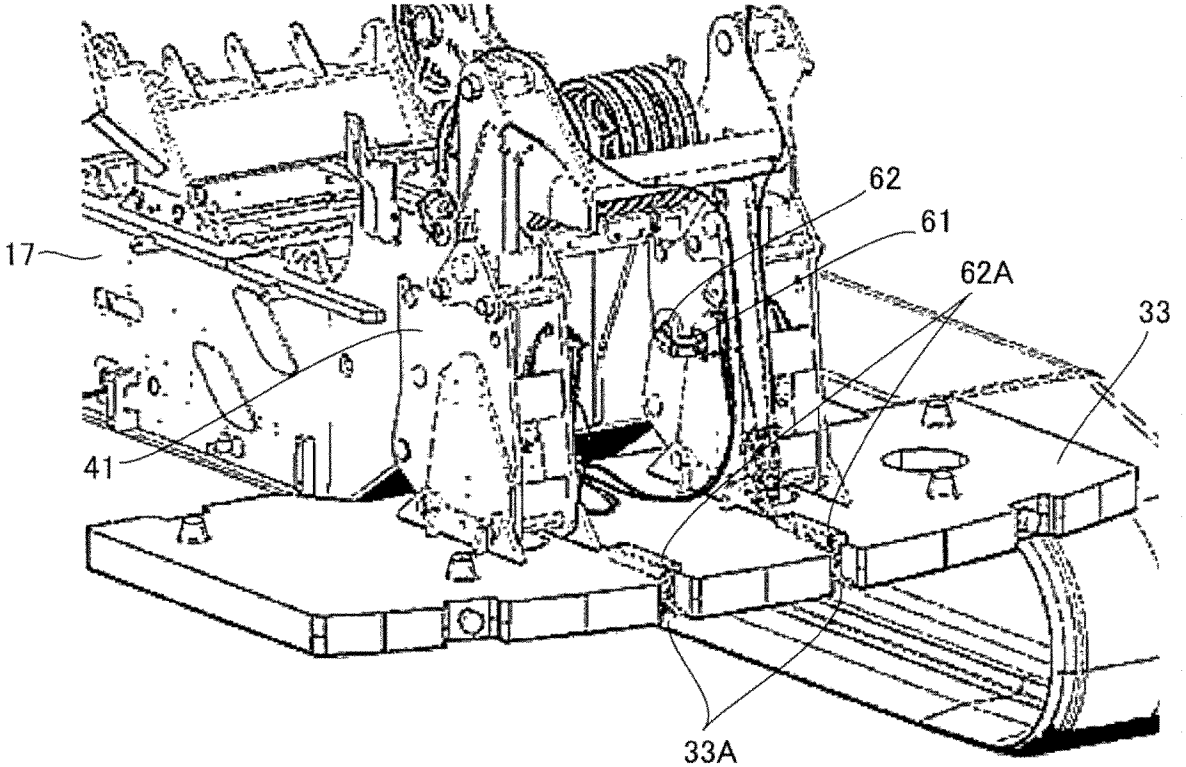
FIG. 11 is a perspective view when a state illustrated in FIG. 7G is viewed from the left rear side of the counterweight attachment/detachment device.

FIG. 11 is a perspective view when a state illustrated in FIG. 7G is viewed from the left rear side of the counterweight attachment/detachment device 19, and FIGS. 12A, 12B, 13A, and 13B are perspective views illustrating a main portion of the second fixing pin insertion/removal mechanism 62 for inserting and removing the second fixing pin 61. In a state illustrated in FIG. 11, the base plate 33 is raised up from the ground, and is located at a predetermined height where the worker 90 easily operates the base plate 33. The cylinder rod 39A of the hydraulic cylinder 39 is fitted into the guide groove 53D, is shrunk to a state where the guide pin 17B is supported by the support groove 41A, and awaits the operation for inserting the second fixing pin 61 into the second fixing pin insertion hole 63. In this state, the worker 90 can stand at a position on the ground where the hand of the worker 90 reaches the second operation lever 62A if the worker 90 stretches out his or her hand in the vicinity of the cutout portion 33A in the rear end of the base plate 33, and can operate the second operation lever 62A. The second operation lever 62A is installed for operating the second lever 62D3 of the second link 62D of the second fixing pin insertion/removal mechanism 62.

The second fixing pin insertion/removal mechanism 62 has a configuration similar to that of the first fixing pin insertion/removal mechanism 46, and is basically configured to include a second link 62D, a second push-pull wire 62B, and a second operation lever 62A. One end of the second push-pull wire 62B is connected to a connection terminal 62D5 of the second operation lever 62A of the second link 62D, and the other end is connected to a connection terminal 62A1 of the second operation lever 62A. The second link 62D includes a second link bracket 62D1 installed on an inner surface of the support bracket 41, and an L-shaped second lever 62D3 supported by the second link bracket 62D1 so as to be capable of oscillating via a spindle 62D2. The second push-pull wire 62B is connected to a connection terminal 62D5 which is an end portion of the second lever 62D3 on the support bracket 41 side, and an operating end 62D4 which is an end portion of the second lever 62D3 on a side protruding from the second link bracket 62D1 of the second lever 62D3 is pivotably attached to an end portion of the second fixing pin 61 by using a pin or a shaft member.

Figure 12A:
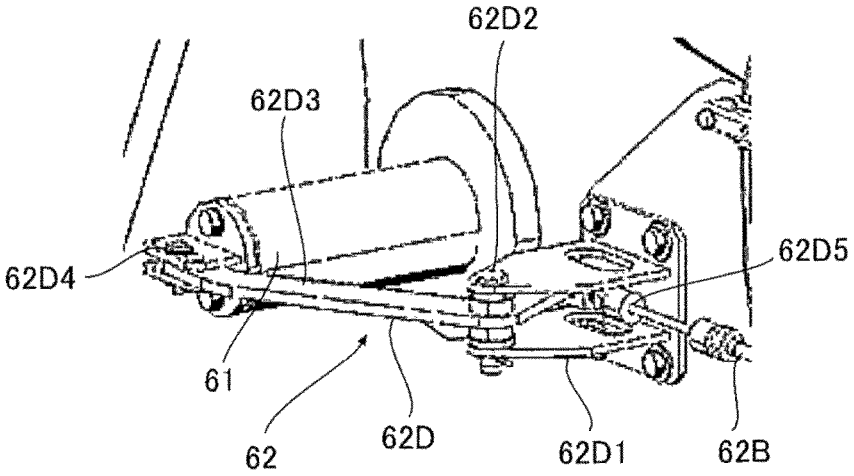
FIG. 12A is a perspective view illustrating the vicinity of a second pin installation portion when a pin of a second fixing pin insertion/removal mechanism for inserting and removing a second fixing pin is not fixed.
Figure 12B:
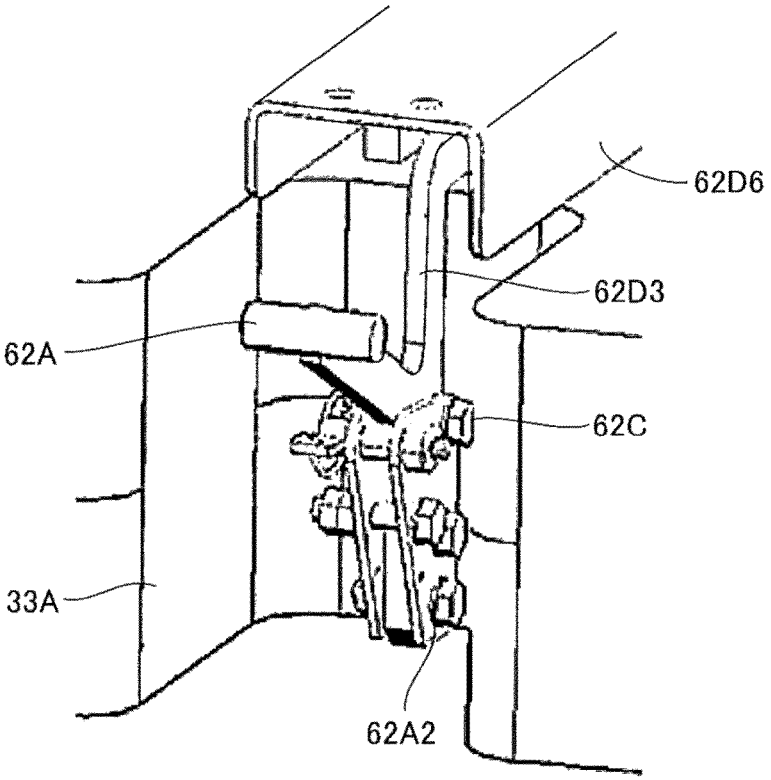
FIG. 12B is a perspective view illustrating the vicinity of a second operation lever installation portion when the pin of the second fixing pin insertion/removal mechanism for inserting and removing the second fixing pin is not fixed.
Figure 13A:
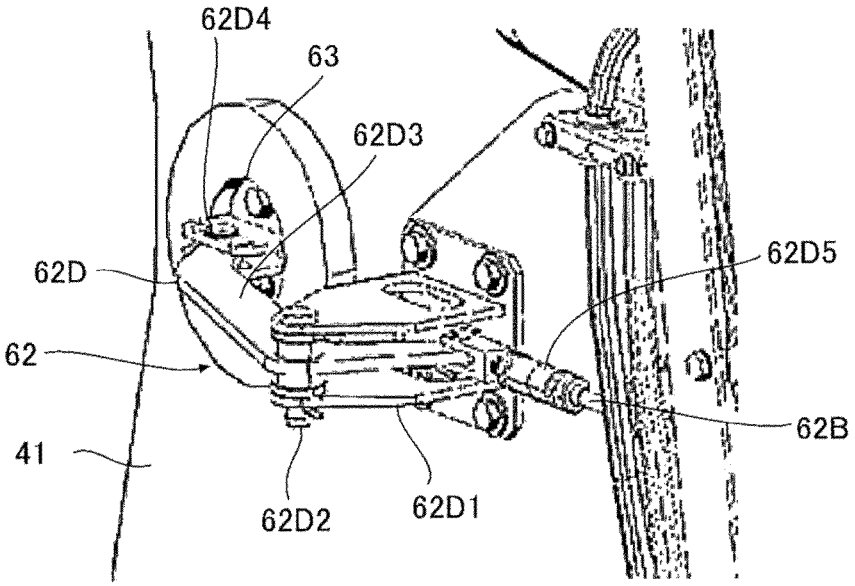
FIG. 13A is a perspective view illustrating the vicinity of the second pin installation portion when the pin of the second fixing pin insertion/removal mechanism for inserting and removing the second fixing pin is fixed.
Figure 13B:
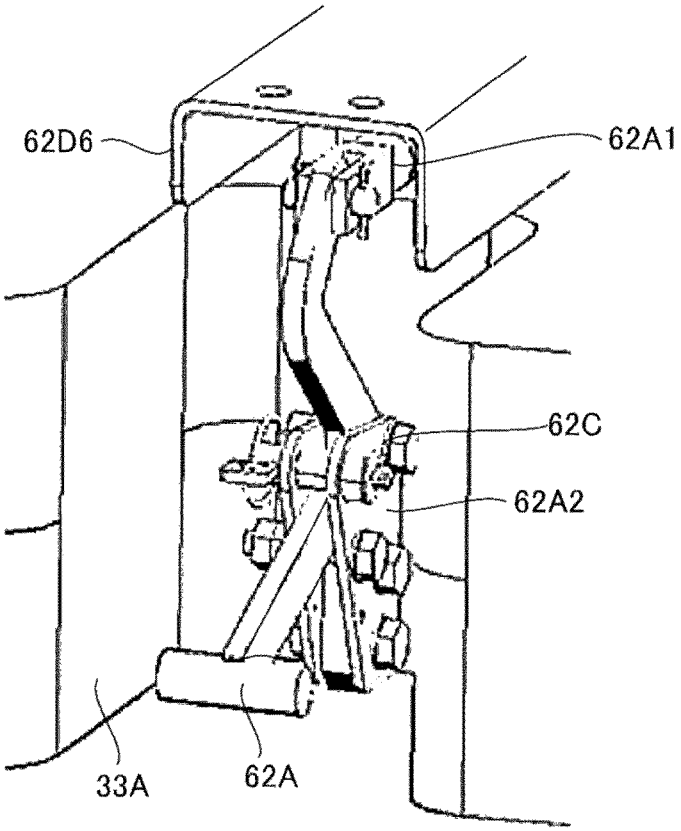
FIG. 13B is a perspective view illustrating the vicinity of the second operation lever installation portion when the pin of the second fixing pin insertion/removal mechanism for inserting and removing the second fixing pin is fixed.

As illustrated in FIGS. 12B and 13B, the second push-pull wire 62B passes through a cover 62D6 from the connection terminal 62A1 of the second operation lever 62A, reaches the upper surface 33B of the base plate 33 from a rear end of the cover 62D6 as illustrated in FIG. 4, and is connected to the connection terminal 62D5 of the second link 62D. The second operation lever 62A is attached to an inner side surface of the cutout portion 33A of the base plate 33 so as to be capable of oscillating with respect to the spindle 62C via the second operation lever the support bracket 62A2. Here, FIG. 12A illustrates a state where the second fixing pin 61 is not inserted, that is, a state where the pin is not fixed. In this state, as illustrated in FIG. 12B, the second operation lever 62A is located at an upper position.

If this state is brought into a state illustrated in FIG. 13B by pulling the first operation lever 46A downward, the second push-pull wire 62B connected to the connection terminal 62A1 is pulled, and the connection terminal 62D5 of the second lever 62D3 of the second link 62D is moved forward in a horizontal direction in the drawing. In this manner, the second lever 62D3 is rotated in the clockwise direction in the drawing. As a result, as illustrated in FIG. 13A, the operating end 62D4 of the second lever 62D3 pushes the second fixing pin 61 into the second fixing pin insertion hole 63. As described above, the support bracket 41 is coupled to the rear end portion 17A of the turning frame 17. As a result, both of these are integrated with each other by the second fixing pin 61, and are brought into a fixed state using the pin.

On the other hand, if the second operation lever 62A is raised upward in a state illustrated in FIG. 13B, the second push-pull wire 62B is pushed back, and the second lever 62D3 pivots in the counterclockwise direction with respect to the spindle 62D2. In this manner, the second fixing pin 61 is removed from the second fixing pin insertion hole 63, and a state illustrated in FIG. 12A is obtained. In this case, the second operation lever 62A is in a state where the pin is not fixed in FIG. 12B. In FIGS. 12A, 12B, 13A, and 13B, only the mechanism on the right side in the drawing is illustrated in the second operation lever 62A and the second fixing pin insertion/removal mechanism 62. However, as illustrated in FIG. 11, the second fixing pin insertion/removal mechanism 62 on the left side which is driven by the second operation lever 62A on the left side is also disposed symmetrically with the second fixing pin insertion/removal mechanism 62 on the right side, and is similarly operated, as a matter of course.

In this way, according to the present embodiment, with regard to the base plate 33 having the counterweight 11 attached thereto on the ground, the cylinder rod 39A of the hydraulic cylinder 39 is shrunk so that the worker 90 in a state of standing on the ground operates the second operation lever 62A. In this manner, the operation of inserting and removing the second fixing pin 61 can be performed. Therefore, the worker 90 does not need to carry out work for inserting the second fixing pin 61 into the second fixing pin insertion hole 63 in a state where the worker 90 rides on the base plate 33. In this manner, similar to the case where the work for inserting and removing the first fixing pin 45 is carried out, it is not necessary to carry out work at a high place. Therefore, the present embodiment can contribute to work safety.

Both the first fixing pin insertion/removal mechanism 46 illustrated in FIGS. 9A, 9B, 10A, and 10B and the second fixing pin insertion/removal mechanism 62 illustrated in FIGS. 12A, 12B, and 13B insert and remove the first fixing pin 45 or the second fixing pin 61 by the worker 90 directly operating the first operation lever 46A or the second operation lever 62A. In contrast, the worker 90 can operate the first fixing pin insertion/removal mechanism 46 and the second fixing pin insertion/removal mechanism 62 without operating the first operation lever 46A or the second operation lever 62A on the base plate 33 or on the ground in the vicinity of the base plate 33 by operating a switch or operating an operation lever of a hydraulic control valve. This example is illustrated in FIGS. 14 and 15.

Figure 14:
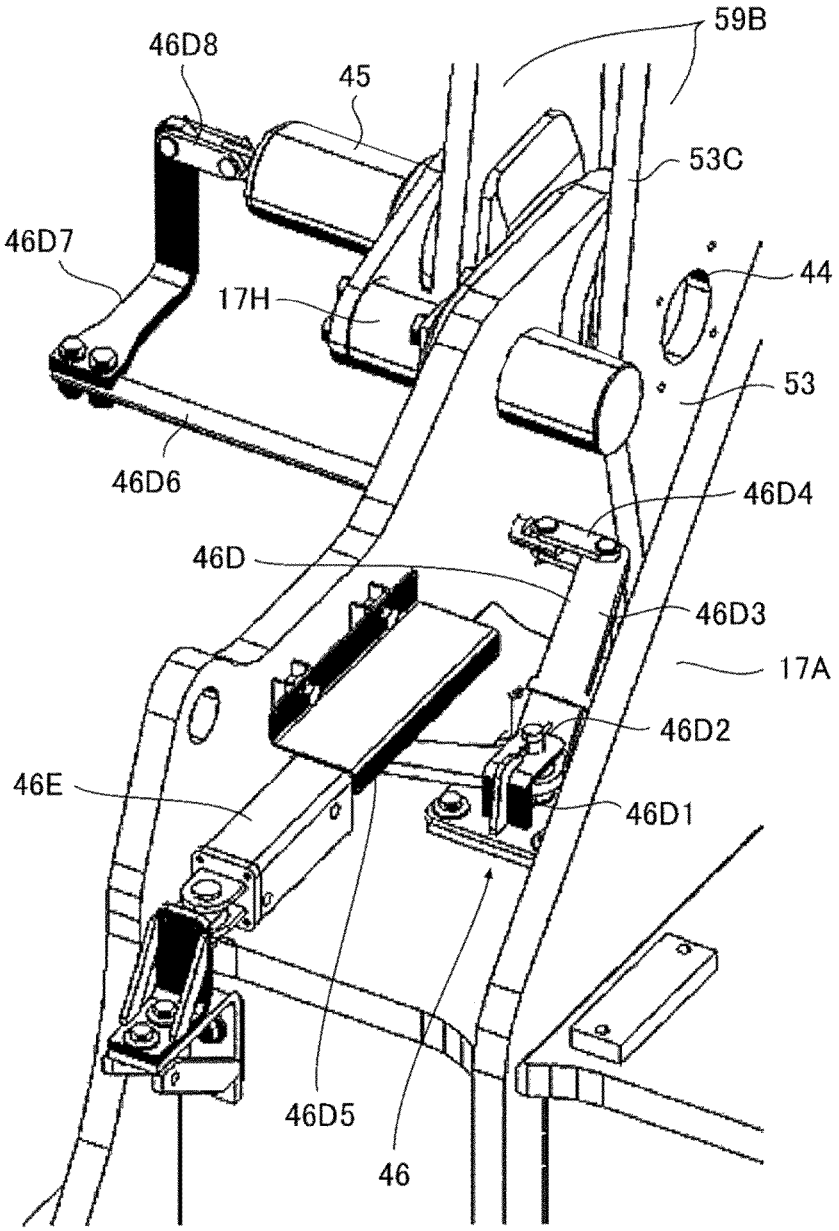
FIG. 14 is a perspective view illustrating an example of the first fixing pin insertion/removal mechanism for driving a first fixing pin drive hydraulic cylinder by using a remote operation.
Figure 15:
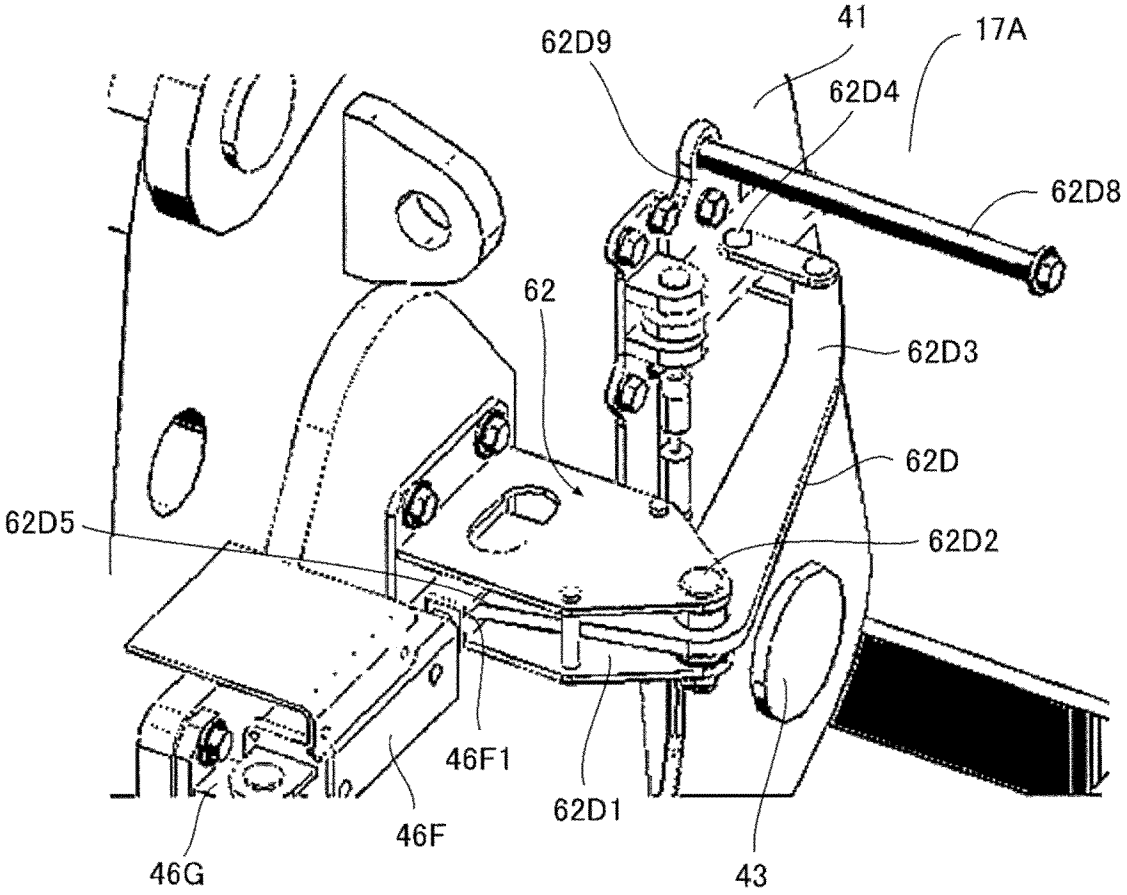
FIG. 15 is a perspective view illustrating an example of the second fixing pin insertion/removal mechanism for driving a second fixing pin drive hydraulic cylinder by using a remote operation.

FIG. 14 is a perspective view illustrating an example of the first fixing pin insertion/removal mechanism 46 which drives a first fixing pin drive hydraulic cylinder 46E by using a remote operation. In an example illustrated in FIG. 14, the first fixing pin insertion/removal mechanism 46 is disposed on the rear end portion 17A side of the turning frame 17. Without using the first push-pull wire 46B, the first link 46D is directly driven by the first fixing pin drive hydraulic cylinder 46E. The first link 46D is configured as follows. One end of the first rod 46D6 is connected to the operating end 46D4 of the first lever 46D3, one end of the second rod 46D7 is connected to the other end of the first rod 46D6, and the operating end 46D8 of the second rod 46D7 is pivotably attached to the end portion of the first fixing pin 45 by using a pin or a shaft member. The first lever 46D3 is attached to the upper surface of the rear end portion 17A of the turning frame 17 by the first link bracket 46D1 so as to be pivotable with respect to the spindle 46D2.

In the cylinder rod of the first fixing pin drive hydraulic cylinder 46E, one end is connected to the connection terminal 46D5 of the first lever 46D3. In a state where the first fixing pin drive hydraulic cylinder 46E is shrunk (FIG. 14), the first lever 46D3 pivots to the maximum in the counterclockwise direction with respect to the spindle 46D2. In this state, the first rod 46D6 is in the most protruding state, and the second rod 46D7 and the first fixing pin 45 which are connected to the first rod 46D6 are located at a position farthest apart from the detachable frame 53. This position is separated from the first fixing pin insertion hole 44 of the first fixing pin 45. The detachable frame 68 is not connected to the turning frame 17, and is in a non-fixed state as a separate body.

In this case, the guide surface 53C on the turning frame 17 side of the detachable frame 53 comes into contact with the stopper pin 17H, and the first fixing pin insertion hole 44 and the first fixing pin receiving hole 17C coincide with each other. In this state, the cylinder rod of the first fixing pin drive hydraulic cylinder 46E is stretched. The cylinder rod is stretched, thereby causing the first lever 46D3 to pivot in the clockwise direction in the drawing. This pivoting causes the first rod 46D6 and the second rod 46D7 to be drawn into the turning frame 17. In synchronization with this operation, the first fixing pin 45 moves into the detachable frame 53, and is inserted into the first fixing pin insertion hole 44 and the first fixing pin receiving hole 17C. In this manner, the detachable frame 53 and the turning frame 17 are coupled to each other, and are brought into a state where both of these are integrally fixed to each other.

The operation of the first fixing pin drive hydraulic cylinder 46E is controlled by pressure oil supplied from the hydraulic hose connected to the hydraulic valve inside the turning frame 17. The pressure oil is controlled by causing an operation lever of a remote control box to operate the directional control valve. If the operation lever of the remote control box is operated in a direction opposite to the movement direction of the first fixing pin 45 to the insertion side, the cylinder rod of the first fixing pin drive hydraulic cylinder 46E is shrunk, and the first lever 46D3 pivots in the counterclockwise direction in the drawing. In response to the operation reverse to the above-described operation, the first fixing pin 45 is separated from the first fixing pin insertion hole 44. In this manner, the detachable frame 53 and the turning frame 17 are uncoupled from each other, and are brought into a separate state.

FIG. 15 is a perspective view illustrating an example in which the second fixing pin insertion/removal mechanism 62 is driven using a remote operation so as to drive the second fixing pin drive hydraulic cylinder 46F. In the example illustrated in FIG. 15, the second fixing pin insertion/removal mechanism 62 is disposed on the support bracket 41 side. Without using the second push-pull wire 62B, the second link 62D is directly driven by the second fixing pin drive hydraulic cylinder 46F. The second link 62D is configured as follows. One end of the second fixing pin 61 is pivotably coupled to the operating end 62D4 of the second lever 62D3 via a hanger 62D9 by using a pin or a shaft member so that the hanger 62D9 is movable along a guide bar 62D8. The second lever 62D3 is pivotably attached to a side surface of the support bracket 41 by the second link bracket 62D1 so as to be pivotable with respect to the spindle 62D2.

The second fixing pin drive hydraulic cylinder 46F is attached to a side surface of the support bracket 41 via a cylinder bracket 46G. One end of the cylinder rod 46F1 of the second fixing pin drive hydraulic cylinder 46F is connected to the connection terminal 62D5 of the second lever 62D3. In a state where the second fixing pin drive hydraulic cylinder 46F is shrunk (FIG. 15), the second lever 62D3 pivots to the maximum in the counterclockwise direction with respect to the spindle 62D2. In this state, the hanger 62D9 and the second fixing pin 61 are in a state of being pushed the most into the support bracket 41 side. In this state, the second fixing pin 61 passes from the second fixing pin insertion hole 63 through the second fixing pin receiving hole 17D, reaches the second fixing pin insertion hole 63 on the opposite side, and the weight raising/lowering unit 35 and the turning frame 17 are brought into a coupled state. Therefore, in this state, the base plate 33 having the counterweight 11 attached thereto is integrated with the turning frame 17 via the support bracket 41.

Similar to the first fixing pin drive hydraulic cylinder 46E, the second fixing pin drive hydraulic cylinder 46F is also controlled by the pressure oil supplied from the hydraulic hose connected to the hydraulic valve inside the turning frame 17. The pressure oil is controlled by operating the operation lever installed inside the cab 13 to control the directional control valve. If the operation lever installed inside the cab 13 is operated in a direction opposite to the movement direction of the second fixing pin 61 to the insertion side, the cylinder rod 46F1 of the second fixing pin drive hydraulic cylinder 46F is stretched, and the second lever 62D3 pivots in the clockwise direction in the drawing. In response to the operation reverse to the above-described operation, the second fixing pin 61 is separated from the second fixing pin insertion hole 63. In this manner, the support bracket 41 and the turning frame 17 are uncoupled from each other, and are brought into a separate state.

In FIGS. 14 and 15, the insertion/removal operation of the first fixing pin 45 and the second fixing pin 61 is controlled by operating the lever of the remote control box. However, the first and second fixing pin drive hydraulic cylinders 46E and 46F can be replaced by an electric motor. In this case, the electric motor may be controlled by performing a switch operation of an operation panel inside the cab 13. Alternatively, an operation panel including a controller, for example, a portable personal computer (PC) may be separately connected thereto. While positions of the first and second fixing pins 45 and 61 are confirmed, the electric motor may be controlled by performing a key input operation on the operation panel (keyboard).

Figure 16:
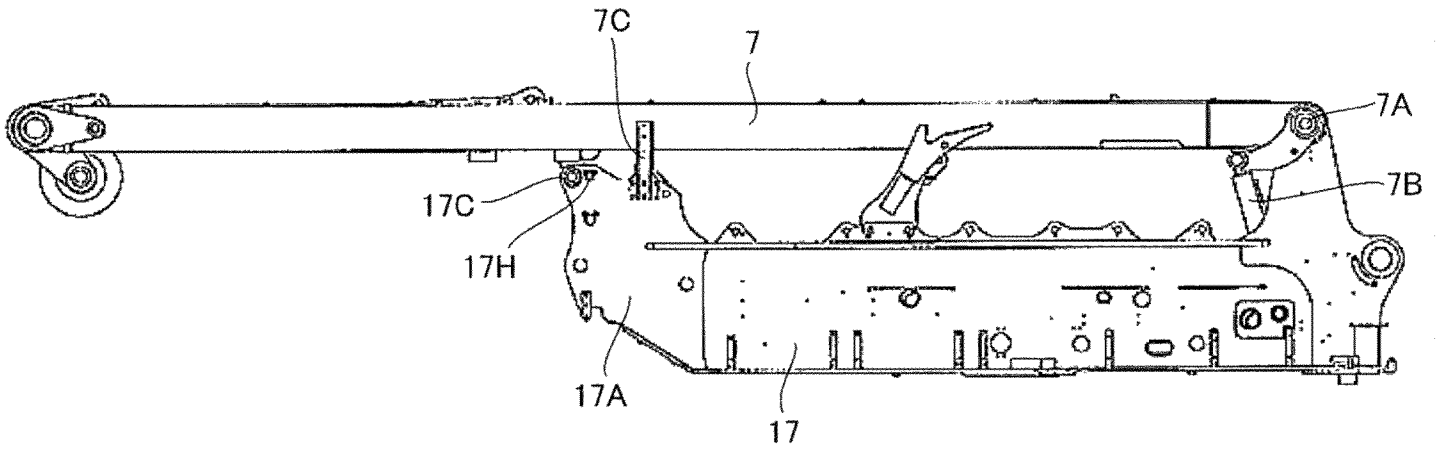
FIG. 16 is a side view of the turning frame illustrating a state where a mast is folded and accommodated rearward when the crawler crane according to the present embodiment is transported while riding on a trailer.

FIG. 16 is a side view of the turning frame 17 illustrating a state when the mast 7 is folded rearward and accommodated when the crawler crane 100 according to the present embodiment is transported on a trailer. The mast 7 is supported by a pair of right and left pivot fulcrums 7A disposed in both end portions in the width direction of the turning frame 17 so as to be pivotable to an accommodation position and a maximum standing position. A flip cylinder 7B for performing the derricking operation on the mast 7 is disposed in each proximal end portion of a pair of the masts 7. In a case where the mast 7 is raised as illustrated in FIG. 1, the cylinder rod of the flip cylinder 7B is stretched. In a case where the mast 7 is accommodated, the cylinder rod of the flip cylinder 7B is shrunk to a minimum position. In this way, a pivoting position of the mast 7 is controlled by performing hydraulic pressure control on the flip cylinder 7B. Similar to the hydraulic cylinder 39, the flip cylinder 7B is also controlled by the pressure oil supplied from the hydraulic hose connected to the hydraulic valve inside the turning frame 17. The pressure oil is controlled by operating the operation lever installed inside the cab 13 to control the directional control valve.

In the present embodiment, when the mast 7 is accommodated in a mast receiver 7C, the highest position of the turning frame 17 is determined by an upper end position when the mast 7 is laid. The reason is as follows. In the present embodiment, it is not necessary to provide a bracket in which the receiver is disposed in the upper end of the rear end portion 17A of the turning frame 17 as disclosed in the related art, for example. The rear end portion 17A and the counterweight attachment/detachment device 19 can be integrated with each other below the upper end of the rear end portion 17A. Therefore, the transport height is defined not by the upper end position of the bracket having the receiver disclosed in the related art, but by the height position when the mast 7 is accommodated. Accordingly, the transport height can be lowered as much as the amount of the bracket protruding from the mast 7 in the related art. In other words, the crawler crane 100 can be transported in a state where the mast 7 is raised to the upper limit of the transport height.

As described above, according to the present embodiment, the following advantageous effects are obtained. In the following description, each configuration element in the claims and each unit according to the present embodiment are in a corresponding relationship. In a case where the terms of both of these are different from each other, the former is indicated using parentheses, or the corresponding reference numerals are given to both of these so as to clarify the correspondence relationship between both of these.

According to the present embodiment, the counterweight attachment/detachment device (counterweight device) 19 has the base plate (mounting table) 33 on which the counterweight 11 to be attached to the turning frame (machine body frame) 17 of the crawler crane (construction machine) 100 is mount, the hydraulic cylinder 39 that raises and lowers the counterweight 11 mounted on the base plate 33 together with the hydraulic cylinder 39, and the detachable frame (connection structure) 53 that connects the base plate 33 and the cylinder rod 39A of the base plate 33 to each other. The cylinder rod 39A is stretched and shrunk, thereby allowing the base plate 33 having the counterweight 11 mounted thereon to be supported by the rear end portion 17A of the turning frame 17. The counterweight attachment/detachment device (counterweight device) 19 includes the support bracket (support member) 41 that supports the hydraulic cylinder 39 on the base plate 33 via the trunnion (oscillating spindle) 47, the first coupling mechanism that couples the detachable frame 53 and the rear end portion 17A of the turning frame 17 to each other at the position where the upper end of the rear end portion 17A is lower than the cylinder top 39C (upper end of the detachable frame 53) when the cylinder rod 39A is stretched, the second coupling mechanism that couples the support bracket 41 and the rear end portion 17A of the turning frame 17 to each other when the cylinder rod 39A is shrunk, the first operation lever (first operation unit) 46A that operates the first coupling mechanism, and the second operation lever (second operation unit) 62A that operates the second coupling mechanism. The first coupling mechanism performs the coupling in the rear side center of gravity state where the center of gravity position when the detachable frame 53 and the hydraulic cylinder 39 are integrated with each other is located on the side farther away from the turning frame 17 side than the vertical line L passing through the center (oscillation fulcrum) of the trunnion 47.

According to this configuration, the cylinder rod 39A of the hydraulic cylinder 39 is stretched at the initial position where the detachable frame 53 and the hydraulic cylinder 39 are inclined in the rear side center of gravity, and the rear end portion 17A of the turning frame 17 is coupled to the detachable frame 53 by the first coupling mechanism. After the coupling, the cylinder rod 39A is shrunk to raise the base plate 33, and the rear end portion 17A of the turning frame 17 is coupled to the support bracket 41 by the second coupling mechanism. In this case, the detachable frame 53 and the rear end portion 17A of the turning frame 17 are coupled to each other by the first coupling mechanism, at the position where the upper end of the rear end portion 17A is lower than the cylinder top 39C corresponding to the upper end of the detachable frame 53. Accordingly, the transport height can be defined by the height of the cylinder top 39C. Therefore, it is possible to reduce the transport height. The detachable frame 53 is disposed on the counterweight attachment/detachment device 19 side. Accordingly, it is possible to reduce the weight of the turning frame 17. As the configuration in which the center of gravity of the detachable frame 53 and the hydraulic cylinder 39 which are the configuration elements on the connection structure side is set as the rear side center of gravity, the member 36 connecting the rear side portions 53B of a pair of the detachable frames 53 to each other may be used, and it is not necessary to provide a heavy weight. Therefore, it is possible to reduce the weight of the counterweight attachment/detachment device 19 including the detachable frame 53 and the hydraulic cylinder 39. Furthermore, the counterweight attachment/detachment device 19 and the turning frame 17 can be coupled to each other by performing remote control from the first operation lever 46A and the second operation lever 62A. Accordingly, the counterweight 11 can be remotely attached to the turning frame 17. In this manner, the worker 90 does not need to carry out work at a high place. Therefore, it is possible to improve work safety.

According to the present embodiment, the counterweight attachment/detachment device (counterweight device) 19 includes the guide surface 53C formed on the end surface of the detachable frame 53 which faces the turning frame 17, the guide groove 53D which is disposed in the lower end of the guide surface 53C and with which the guide pin (guide member) 17B disposed in the rear end portion 17A of the turning frame 17 engages, the support groove 41A which is disposed in the support bracket 41 and which receives a load from the guide pin 17B, and the support bracket connection pin (fitting member) 43 which is disposed in the support bracket 41 and to which the positioning groove 17E formed in the rear end portion 17A of the turning frame 17 is fitted.

According to this construction, when the cylinder rod 39A is stretched, the guide pin 17B comes into contact with the guide surface 53C, and is further guided to the guide surface 53C so as to engage with the guide groove 53D. Accordingly, in response to the stretched cylinder rod 39A, the rear end portion 17A of the turning frame 17 can be lifted.

In the present embodiment, in the counterweight attachment/detachment device (counterweight device) 19, the guide surface 53C includes the upper guide surface 53C1 whose lower side is inclined in the direction away from the vertical line L when the hydraulic cylinder 39 is located at the position where the axis of the cylinder rod 39A coincides with the vertical line (virtual line) L passing through the center (oscillation fulcrum) of the trunnion 47, and the lower guide surface 53C2 which is parallel to the vertical line L. The guide groove 53D is disposed in the lower end portion of the lower guide surface 53C2. Accordingly, in response to the stretched cylinder rod 39A, the guide pin 17B in contact with the guide surface 53C can be guided to the guide groove 53D along the guide surface 53C.

According to the present embodiment, in the counterweight attachment/detachment device (counterweight device) 19, the first coupling mechanism includes the first fixing pin insertion hole (first insertion hole) 44 formed in the detachable frame 53, the first fixing pin receiving hole (first receiving hole) 17C formed in the rear end portion 17A, the stopper pin (positioning member) 17H for positioning the first fixing pin insertion hole 44 and the first fixing pin receiving hole 17C so as to coincide with each other, and the first fixing pin insertion/removal mechanism (first pin drive unit) 46 which couples the detachable frame 53 and the rear end portion 17A of the turning frame 17 to each other by operating the first operation lever 46A so as to insert the first fixing pin (first pin) 45 from the first fixing pin insertion hole 44 into the first fixing pin receiving hole 17C, when the guide pin 17B engage with the guide groove 53D and the first fixing pin insertion hole 44 of the detachable frame 53 and the first fixing pin receiving hole 17C of the rear end portion 17A are positioned by the stopper pin 17H.

According to this configuration, in a state of being positioned by the stopper pin 17H, the first fixing pin insertion hole 44 and the first fixing pin receiving hole 17C coincide with each other. Therefore, the first fixing pin insertion/removal mechanism 46 is operated by the first operation lever 46A. The first fixing pin 45 is inserted into the first fixing pin insertion hole 44, and is inserted into the first fixing pin receiving hole 17C. In this manner, the detachable frame 53 and the rear end portion 17A of the turning frame 17 can be coupled to each other simply by performing the pin inserting operation of the first operation lever 46A.

According to the present embodiment, in the counterweight attachment/detachment device (counterweight device) 19, the first operation lever 46A is disposed at the position where the first operation lever 46A is operable on the base plate 33, and the first fixing pin insertion/removal mechanism 46 inserts and removes the first fixing pin 45 into and from the first fixing pin insertion hole 44 and the first fixing pin receiving hole 17C by performing the remote control from the first operation lever 46A. According to this construction, the worker 90 can couple the detachable frame 53 and the rear end portion 17A of the turning frame 17 on the base plate 33.

According to the present embodiment, in the counterweight attachment/detachment device (counterweight device) 19, the second coupling mechanism includes the second fixing pin insertion hole (second insertion hole) 63 formed in the detachable frame 53, the second fixing pin receiving hole 17D formed in the rear end portion 17A, and the second fixing pin insertion/removal mechanism (second pin drive unit) 62 which couples the support bracket 41 and the rear end portion 17A to each other by operating the second operation lever 62A so as to insert the second fixing pin (second pin) 61 from the second fixing pin insertion hole 63 into the second fixing pin receiving hole 17D, when the positioning groove 17E is fitted to the support bracket connection pin (fitting member) 43 and the second fixing pin insertion hole 63 of the detachable frame 53 and the second fixing pin receiving hole 17D of the rear end portion 17A are positioned so as to coincide with each other.

According to this configuration, if the positioning groove 17E is fitted to the support bracket connection pin 43, the second fixing pin insertion hole 63 of the detachable frame 53 and the second fixing pin receiving hole 17D of the rear end portion 17A are positioned so as to coincide with each other. At the position where both of these are positioned, the second operation lever 62A is operated so as to insert the second fixing pin 61 from the second fixing pin insertion hole 63 into the second fixing pin receiving hole 17D. In this manner, the support bracket 41 and the rear end portion 17A can be coupled to each other simply by performing the pin inserting operation of the second operation lever.

According to the present embodiment, in the counterweight attachment/detachment device (counterweight device) 19, when the base plate 33 is raised, the second operation lever 62A is disposed at the preset position where the base plate 33 is operable by the worker 90 standing on the ground, for example, in the rear end portion. The second fixing pin insertion/removal mechanism 62 (second pin drive unit) inserts and removes the second fixing pin 61 into and from the second fixing pin insertion hole 63 and the second fixing pin receiving hole 17D by performing the remote control from the second operation lever 62A. According to this construction, the second operation lever 62A of the base plate 33 raised to the position where the base plate 33 is operable by the worker 90 is operated on the ground. In this manner, the support bracket 41 and the rear end portion 17A of the turning frame 17 can be coupled to each other.

According to the present embodiment, in the counterweight attachment/detachment device (counterweight device) 19, the remote operation can be performed on the first or second push-pull wire 46B or 62B, the first or second fixing pin drive hydraulic cylinder (hydraulic cylinder) 46E or 46F via the electric motor. According to this configuration, the worker 90 does not need to carry out the work of lifting the fixing pin as in the related art and inserting the fixing pin into the predetermined insertion hole. Therefore, the worker 90 can more efficiently carry out the work. Since the worker 90 does not need to carryout work at a high place, it is possible to improve work safety.

According to the crawler crane (construction machine) 100 including the counterweight attachment/detachment device (counterweight device) 19 in the above-described embodiment, it is possible to provide the crawler crane 100 which obtains the advantageous effects of the above-described respective embodiments.

In the crawler crane 100 including the counterweight attachment/detachment device (counterweight device) according to the above-described embodiment, the crawler crane 100 includes the mast 7. When the mast 7 is folded during the transportation, the transport height of the counterweight attachment/detachment device 19 and the turning frame 17 is lower than the transport height of the folded mast 7. According to this configuration, the maximum transport height corresponds to the maximum transport height of the folded mast 7. Accordingly, it is necessary to consider the maximum transport height of the counterweight attachment/detachment device 19 or the turning frame 17.

It should be understood that the invention is not limited to the above-described embodiment, but may be modified into various forms on the basis of the spirit of the invention. Additionally, the modifications are included in the scope of the invention.

What is claimed is:

1. A counterweight device attachable to a rear end portion of a machine body frame, which includes a mounting table on which a counterweight is mounted, a hydraulic cylinder that raises and lowers the mounting table, and a connection structure that connects the mounting table and a cylinder rod of the hydraulic cylinder, in which stretching and shrinking operations of the cylinder rod enables the mounting table to be supported by the rear end portion, the counterweight device comprising:

a support member that supports the hydraulic cylinder on the mounting table via an oscillating spindle;

a first coupling mechanism that couples the connection structure and the rear end portion of the machine body frame to each other at a position where an upper end of the rear end portion is lower than an upper end of the connection structure, when the cylinder rod is stretched;

a second coupling mechanism that couples the support member and the rear end portion of the machine body frame to each other, when the cylinder rod is shrunk;

a first operation unit that operates the first coupling mechanism; and a second operation unit that operates the second coupling mechanism, wherein the first coupling mechanism performs the coupling in a rear side center of gravity state where a center of gravity position when the connection structure and the hydraulic cylinder are integrated with each other is located on a side farther away from the machine body frame side than a vertical line passing through the center of the oscillating spindle.

2. The counterweight device according to claim 1, further comprising:

a guide surface that is formed on an end surface facing the machine body frame of the connection structure;

a guide groove that is disposed in a lower end of the guide surface, and with which a guide member disposed in the rear end portion of the machine body frame engages;

a support groove that is disposed in the support member, and that receives a load from the guide member; and a fitting member that is disposed in the support member, and with which a positioning groove formed in the rear end portion of the machine body frame engages.

3. The counterweight device according to claim 2, wherein the guide surface includes an upper guide surface inclined in a direction where a lower side is apart from the vertical line when the hydraulic cylinder is located at a position where an axis of the cylinder rod coincides with the vertical line, and a lower guide surface parallel to the vertical line, and wherein the guide groove is disposed in a lower end portion of the lower guide surface.

4. The counterweight device according to claim 2, wherein the first coupling mechanism includes a first insertion hole formed in the connection structure, a first receiving hole formed in the rear end portion, a positioning member that positions the first insertion hole and the first receiving hole so as to coincide with each other, and a first pin drive unit that couples the connection structure and the rear end portion to each other by operating the first operation unit so as to insert a first pin into the first receiving hole through the first insertion hole, when the guide member engages with the guide groove and the first insertion hole of the connection structure and the first receiving hole of the rear end portion are positioned by the positioning member.

5. The counterweight device according to claim 4, wherein the first operation unit is disposed at a position where the first operation unit is operable on the mounting table, and the first pin drive unit inserts and removes the first pin into and from the first insertion hole and the first receiving hole by using a remote operation from the first operation unit.

6. The counterweight device according to claim 5, wherein the remote operation is performed via a push-pull wire, a hydraulic cylinder, or an electric motor.

7. The counterweight device according to claim 2, wherein the second coupling mechanism includes a second insertion hole formed in on the support member, a second receiving hole formed in the rear end portion, and a second pin drive unit that couples the support member and the rear end portion to each other by operating the second operation unit so as to insert a second pin into the second receiving hole through the second insertion hole, when the positioning groove is fitted to the fitting member and the second insertion hole of the support member and the second receiving hole of the rear end portion are positioned so as to coincide with each other.

8. The counterweight device according to claim 7, wherein the second operation unit is disposed at a preset position of the mounting table where the second operation unit is operable on the ground when the mounting table is raised, and the second pin drive unit inserts and removes the second pin into and from the second insertion hole and the second receiving hole by using a remote operation from the second operation unit.

9. A construction machine comprising:

the counterweight device according to claim 1.

10. The construction machine according to claim 9, further comprising:

a mast, wherein when the mast is folded during transportation, a transport height of the counterweight device and the machine body frame is lower than a transport height of the folded mast.

* * * * *